US007984958B2

(12) United States Patent
Koga et al.

(10) Patent No.: US 7,984,958 B2
(45) Date of Patent: Jul. 26, 2011

(54) IMAGE-RECORDING DEVICE

(75) Inventors: Yuji Koga, Nagoya (JP); Masatoshi Izuchi, Nagoya (JP); Tetsuo Asada, Kuwana (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 971 days.

(21) Appl. No.: 11/536,747

(22) Filed: Sep. 29, 2006

(65) Prior Publication Data

US 2007/0076036 A1 Apr. 5, 2007

(30) Foreign Application Priority Data

Sep. 30, 2005 (JP) ..... 2005-286154

(51) Int. Cl.
*B41J 29/38* (2006.01)
*B41J 2/01* (2006.01)

(52) U.S. Cl. ..... 347/16; 347/104

(58) Field of Classification Search ..... 347/16, 347/101, 103, 104, 105
See application file for complete search history.

(56) References Cited

U.S. PATENT DOCUMENTS

| | | | |
|---|---|---|---|
| 5,841,450 | A | 11/1998 | Kawamura |
| 6,161,917 | A | 12/2000 | Igarashi et al. |
| 6,341,835 | B1 | 1/2002 | Ogawa et al. |
| 6,533,263 | B2 | 3/2003 | Tamura |
| 2007/0048058 | A1 | 3/2007 | Koga et al. |
| 2007/0057447 | A1 | 3/2007 | Asada et al. |
| 2007/0231044 | A1 | 10/2007 | Koga et al. |

FOREIGN PATENT DOCUMENTS

| | | | |
|---|---|---|---|
| EP | 0422794 | A2 | 4/1991 |
| EP | 1574340 | A2 | 9/2005 |
| EP | 1574341 | A1 | 9/2005 |
| EP | 1574349 | A1 | 9/2005 |
| EP | 1759860 | A1 | 3/2007 |
| GB | 2181392 | A | 4/1987 |
| JP | S58-119533 | A | 7/1983 |
| JP | S61-188148 | A | 8/1986 |

(Continued)

OTHER PUBLICATIONS

Japanese Office Action issued in corresponding Japanese Application No. 2005-286154, mailing date Jun. 25, 2008.

(Continued)

*Primary Examiner* — Matthew Luu
*Assistant Examiner* — Jannelle M Lebron
(74) *Attorney, Agent, or Firm* — Baker Botts L.L.P.

(57) ABSTRACT

In an image-recording device, a feeding roller feeds recording media one at a time from a media-accommodating unit along a conveying path. A pair of registration rollers is disposed on the conveying path and conveys the recording medium fed by the feeding roller to an image-recording region. The registration rollers include a drive roller. A carriage reciprocates in the image-recoding region in a direction intersecting a conveying direction in which the recording medium is conveyed. A recording head is mounted on the carriage. A drive transmission switching unit is disposed outside the image-recording region on one end with respect to the reciprocating direction of the carriage and switches a combination of rotating and halted states of the drive roller in the registration rollers and the feeding roller between a continuous feeding mode and an intermittent feeding mode. A controlling unit activates the drive transmission switching unit by moving the carriage to selectively switch between the continuous feeding mode and the intermittent feeding mode.

13 Claims, 19 Drawing Sheets

FOREIGN PATENT DOCUMENTS

| | | | | |
|---|---|---|---|---|
| JP | 62235139 | A | * | 10/1987 |
| JP | H62-235139 | A | | 10/1987 |
| JP | S63-176232 | A | | 7/1988 |
| JP | H01-218926 | A | | 9/1989 |
| JP | H02-144334 | A | | 6/1990 |
| JP | H07-259878 | A | | 10/1995 |
| JP | H11-322137 | A | | 11/1999 |
| JP | 2001-058742 | A | | 3/2001 |
| JP | 2001058742 | A | * | 3/2001 |
| JP | 2001-301998 | A | | 10/2001 |
| JP | 2002-068500 | A | | 3/2002 |
| JP | 2002-104697 | A | | 4/2002 |
| JP | 2002104697 | A | * | 4/2002 |
| JP | 2002-283637 | A | | 10/2002 |
| JP | 2002283637 | A | * | 10/2002 |

OTHER PUBLICATIONS

European Patent Office, European Search Report for Related EP Application No. 06020420 dated Jan. 3, 2007.

Decision of Rejection issued in corresponding Japanese Application No. 2005-286154, mailing date Nov. 5, 2008.

Japan Patent Office, Office Action for Japanese Patent Application No. 2005-286154 (counterpart to above-captioned patent application), mailed Dec. 1, 2009.

* cited by examiner

IMAGE-RECORDING DEVICE

CROSS REFERENCE TO RELATED APPLICATION

This application claims priority from Japanese Patent Application No. 2005-286154 filed Sep. 30, 2005, the entire content of which is incorporated herein by reference.

TECHNICAL FIELD

The disclosure relates to an image-recording device for recording images on a recording medium, such as cut sheets of paper.

BACKGROUND

Some conventional image-recording devices include a paper cassette accommodating a plurality of cut sheets of paper or the like in a stacked state, the conveying path along which the sheets are conveyed from the paper cassette one sheet at a time, and an image-recording unit disposed along the conveying path for sequentially recording images on the sheets. In recent years, these image-recording devices have been provided with a pair of registration rollers disposed on the conveying path upstream of the image-recording unit in the paper-conveying direction for setting an image-recording start position a predetermined distance (length) from the leading edge of the paper and for preventing skewing in the paper (hereinafter referred to as registering the paper).

SUMMARY

In order to register the paper in this type of image-recording device, the registration rollers are rotated in a direction opposite the direction for conveying the paper to the image-recording unit or are maintained in a halted state. Accordingly, when the leading edge of the sheet of paper contacts the registration rollers, the leading edge of the sheet flexes and the sheet is not conveyed to the image-recording unit. By forcing the leading edge portion of the paper to flex, the registration rollers set a start position for recording an image on the paper at a predetermined distance from the leading edge thereof and prevent the paper from skewing. Subsequently, with the leading edge portion of the paper in a flexed state, the registration rollers begin rotating in a direction for conveying the paper to the image-recording unit, thereby conveying the paper to the prescribed image-recording start position without allowing skew in the paper. By performing this feeding operation for each sheet of paper and by feeding each sheet intermittently from the paper cassette, it is possible to form an appropriate gap between the trailing edge of a preceding sheet of paper and the leading edge of a succeeding sheet.

However, when sheets are fed intermittently in this way, a longer time is required for recording images consecutively on a plurality of sheets of paper, thereby making high-speed recording impossible.

This structure is particularly problematic when employing a single motor for driving a feeding roller to separate and feed paper from the paper cassette, the pair of registration rollers, and discharge rollers disposed downstream of the image-recording unit in the paper conveying direction. With this construction, the rotating direction of the feeding roller and the pair of registration rollers with respect to the paper conveying direction differs when the feeding roller conveys paper to the registration rollers to undergo registration. Further, since it is also necessary to halt the feeding roller while the registration rollers are conveying paper to the image-recording unit, the gap between sheets of paper increases, reducing the speed and efficiency of image recording.

U.S. Pat. No. 6,533,263 B2 discloses a sheet-conveying device for continuously conveying sheets of paper from a paper cassette toward an image-forming unit (photosensitive drum). This sheet-conveying device includes a first conveying unit disposed on the upstream side of a paper-conveying path, a second conveying unit disposed on the downstream side of the paper-conveying path, and a paper-detecting unit disposed between the first conveying unit and second conveying unit. The conveying speed of the second conveying unit is set faster than that of the first conveying unit. When the sheet-conveying device conveys paper from the paper cassette continuously, the first conveying unit begins conveying sheets so that a portion of the trailing edge of a preceding sheet overlaps a portion of the leading edge of a succeeding sheet in the conveying direction. However, a gap is opened between the preceding sheet and the succeeding sheet so that the paper-detecting unit can detect the leading edge of the succeeding sheet.

A sheet-conveying device disclosed in Japanese unexamined patent application publication No. 2002-283637 suitably controls the gap between the preceding sheet and the succeeding sheet based on the recording format, such as whether the printing mode is set for high quality or for ordinary text data.

It is therefore an object of the invention to provide an improved image-recording device that is capable of supporting, by changing the paper feeding modes, both cases in which a user wishes to emphasize image quality rather than high-speed image recording, and when the user wishes to emphasize high-speed image recording rather than image quality.

In order to attain the above and other objects, the invention provides an image-recording device for recording an image on a recording medium. The image-recording device includes: a media-accommodating unit; a conveying path; a feeding roller; a pair of registration rollers; an image-recording unit; a drive transmission switching unit; and a controlling unit. The media-accommodating unit accommodates a plurality of recording media in a stacked state. The recording medium is conveyed along the conveying path. The feeding roller feeds the recording media one at a time from the media-accommodating unit along the conveying path. The pair of registration rollers is disposed on the conveying path and conveys the recording medium fed by the feeding roller to an image-recording region. The registration rollers include a drive roller. The image-recording unit includes a carriage that reciprocates in the image-recording region in a direction intersecting a conveying direction in which the recording medium is conveyed, and a recording head mounted on the carriage and recording an image on the recording paper. The drive transmission switching unit is disposed outside the image-recording region on one end with respect to the reciprocating direction of the carriage and switches a combination of rotating and halted states of the drive roller in the registration rollers and the feeding roller between a continuous feeding mode and an intermittent feeding mode. The controlling unit activates the drive transmission switching unit by moving the carriage to selectively switch between the continuous feeding mode and the intermittent feeding mode.

BRIEF DESCRIPTION OF THE DRAWINGS

In the drawings:

FIG. 14A and FIG. 14B are explanatory diagrams illustrating a paper-returning process that is performed in the continuous feeding mode if the leading edge of a succeeding sheet has not reached a detection position when one page worth of image recording has been completed on the preceding sheet of paper, wherein FIG. 14A shows a first step in the paper-returning process, and FIG. 14B shows a second step in the paper-returning process;

FIG. 14C and FIG. 14D are explanatory diagrams illustrating the paper-returning process that is performed in the continuous feeding mode if the leading edge of a succeeding sheet has already reached the detection position when one page worth of image recording has been completed on the preceding sheet of paper, wherein FIG. 14C shows a first step in the paper-returning process, and FIG. 14C shows a second step in the paper-returning process;

DETAILED DESCRIPTION

Figure 1:
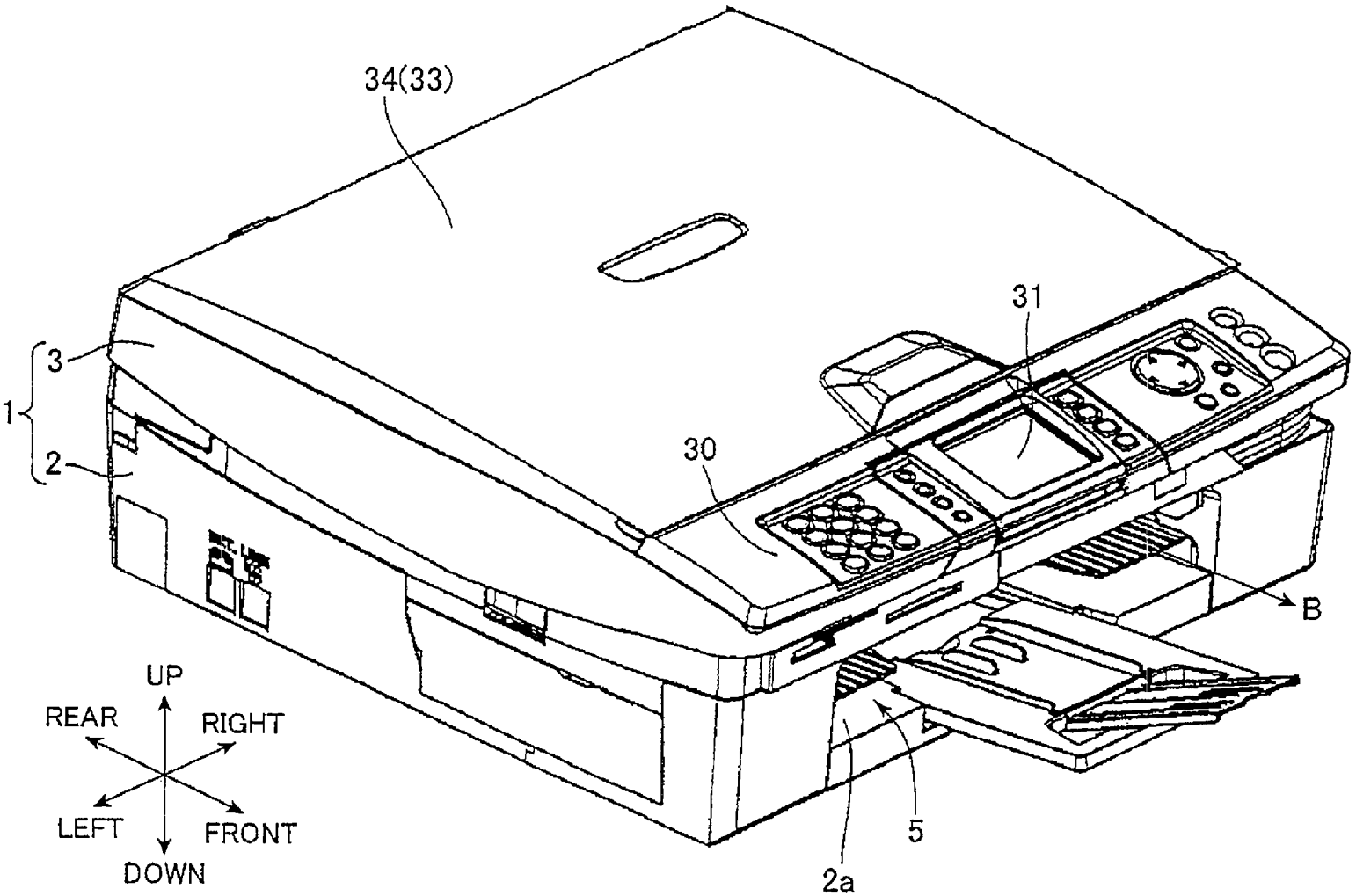
FIG. 1 is a perspective view showing the outer appearance of an image-recording device according to an embodiment of the invention.

Next, an image-recording device 1 according to some aspects of the invention will be described while referring to the accompanying drawings wherein like parts and components are designated by the same reference numerals to avoid duplicating description.

The image-recording device 1 shown in FIG. 1 has multiple functions, such as a facsimile function, printer function, copier function, and scanner function. This multifunctional image-recording device 1 includes a main casing 2 that is substantially box-shaped and open on the top surface, an upper casing 3 that is pivotably supported about a hinge or other rotating assembly (not shown) so as to open and close vertically over the main casing 2. In the following description, the near side of the image-recording device 1 in FIG. 1 will be referred to as the "front side"; and the left-to-right direction (main scanning direction), the front-to-rear direction (sub-scanning direction), and vertical direction will be described based on the orientation of the image-recording device 1 in FIG. 1. In use, the image-recording device 1 is disposed as shown in FIG. 1. The main casing 2 and upper casing 3 are formed by injection molding of synthetic resin.

A control panel 30 is provided on the front top surface of the upper casing 3. The control panel 30 includes numerical buttons, a start button, functional buttons, and the like that are pressed to perform various operations. The control panel 30 also includes a display unit 31, such as a liquid crystal display for displaying current settings of the image-recording device 1, various operating messages, and the like as needed.

The upper casing 3 also includes a scanning unit 33 disposed on the rear side of the control panel 30 for reading images from a facsimile original to be transmitted to another facsimile device when using the facsimile function or to read images from an original being copied when using the copier function. The scanning unit 33 includes a flatbed scanning unit for scanning images from an original placed on a large glass plate; and a cover 34 rotatably disposed for covering the top surface of the flatbed scanning unit.

While not shown in the drawings, a line-type contact images sensor (CIS) is provided directly beneath the glass plate in the flatbed scanning unit as a photoelectric converting element for scanning the image surface of the original contacting the glass plate. The CIS reciprocates along a guiding shaft extending in a direction parallel to the reciprocating direction (main scanning direction or left-to-right direction) of a carriage described later.

The cover 34 is capable of rotating open and closed via hinges about the rear side (far side in FIG. 1) of the image-recording device 1.

The upper casing 3 can rotate about the left edge of the main casing 2 in FIG. 1 so as to open upward and widely over the main casing 2. A position maintaining unit is provided for maintaining the open position of the upper casing 3. The position maintaining unit includes a guide rail (not shown) fixed to one side on the bottom surface of the upper casing 3 (near the rear surface side of the image-recording device 1) and extending parallel to the reciprocating direction of the CIS. The guide rail has an elongated guiding hole extending in the same direction as the guide rail. A support rod (not shown) has a base end rotatably supported on the side of the main casing 2 farthest from the rotating assembly, and a distal end (top end) having a guide pin that is fittingly inserted into the guiding hole of the guide rail and is capable of moving therein. An engaging part (not shown) is also formed in the elongated guiding hole as an upward cutout portion on the far side from the rotating assembly. The upper casing 3 can be maintained at a large prescribed angle to the main casing 2 by fitting the guide pin in this engaging part.

Figure 4:
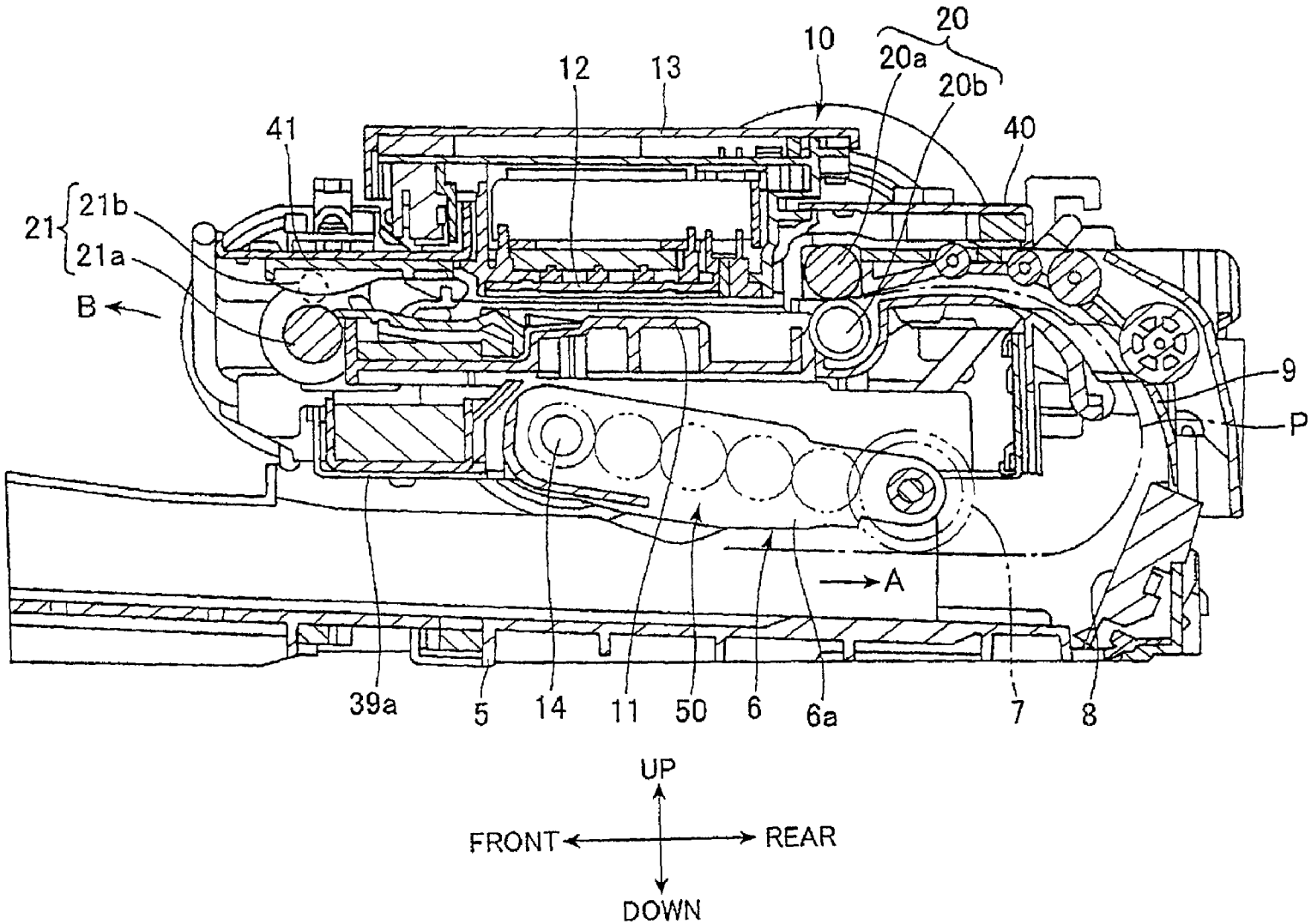
FIG. 4 is a side cross-sectional view of the image-recording device, taken along a line IV-IV in FIG. 3, when a paper cassette is mounted in the image-recording device.

Next, the structure of a printing unit will be described. As shown in FIG. 1, a paper cassette 5 is disposed in the left-to-right center region of the main casing 2. The paper cassette 5 accommodates a plurality of sheets of a paper P stacked in a substantial horizontal state on the bottom of the paper cassette 5. The paper cassette 5 can be pulled out through an opening 2*a* formed in the front surface of the main casing 2. As shown in FIG. 4, a sloped separating surface 8 is provided on the rear end of the paper cassette 5. A separating member (not shown) having a large frictional coefficient is disposed on the sloped separating surface 8.

Figure 2:
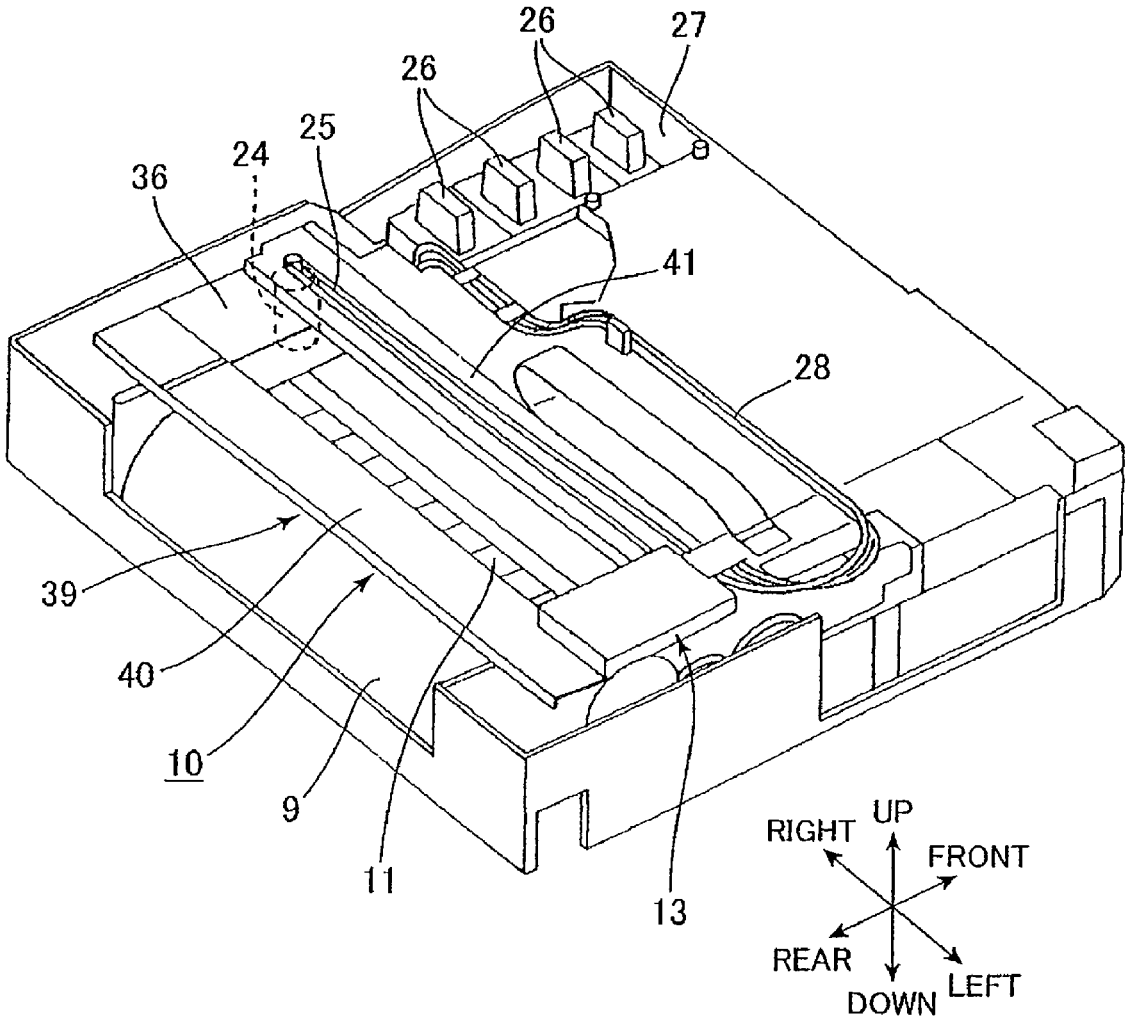
FIG. 2 is a perspective view from the rear side of a main casing in the image-recording device when an upper casing has been removed.
Figure 3:
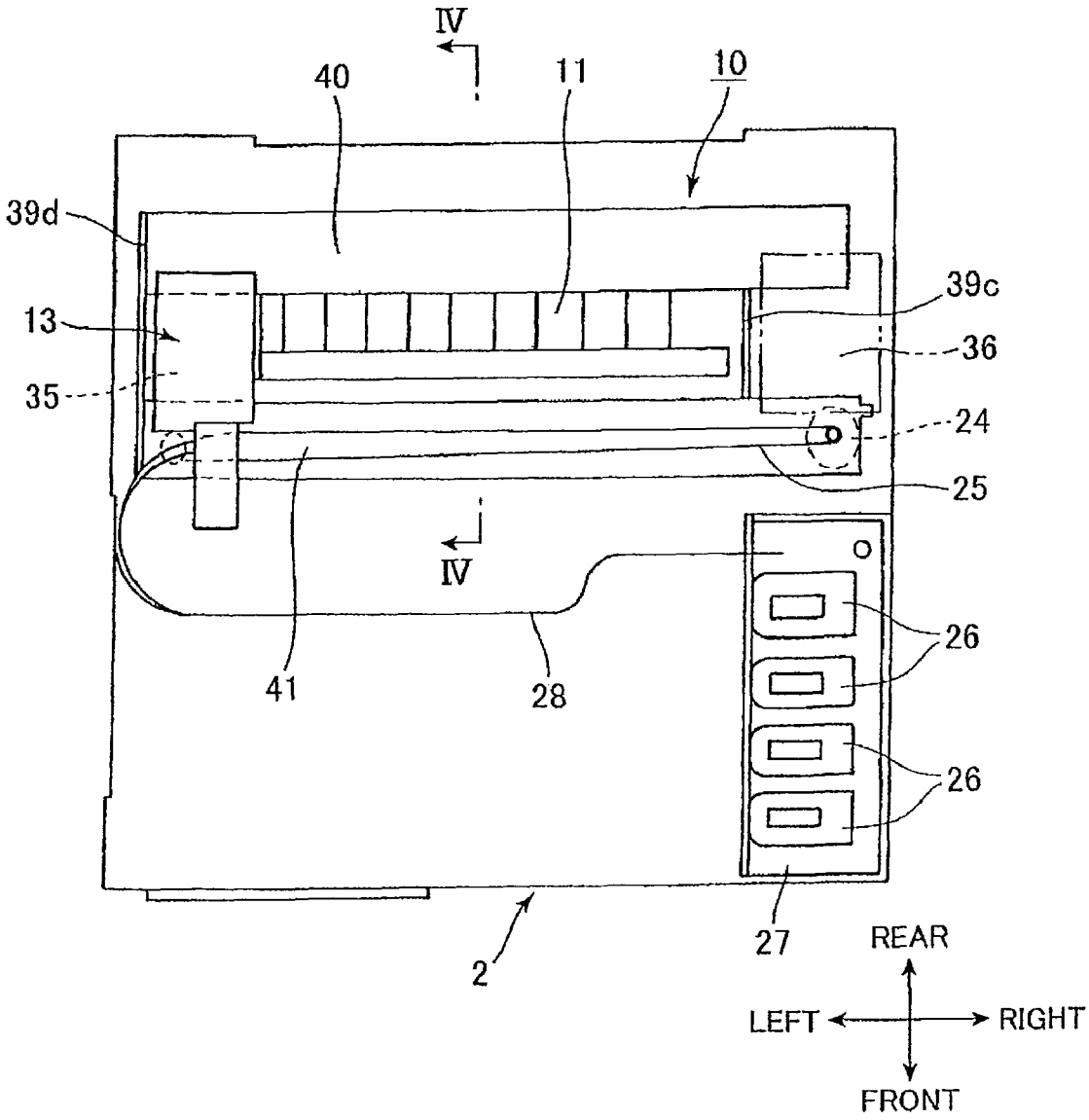
FIG. 3 is a plan view of the main casing in FIG. 2.
Figure 5:
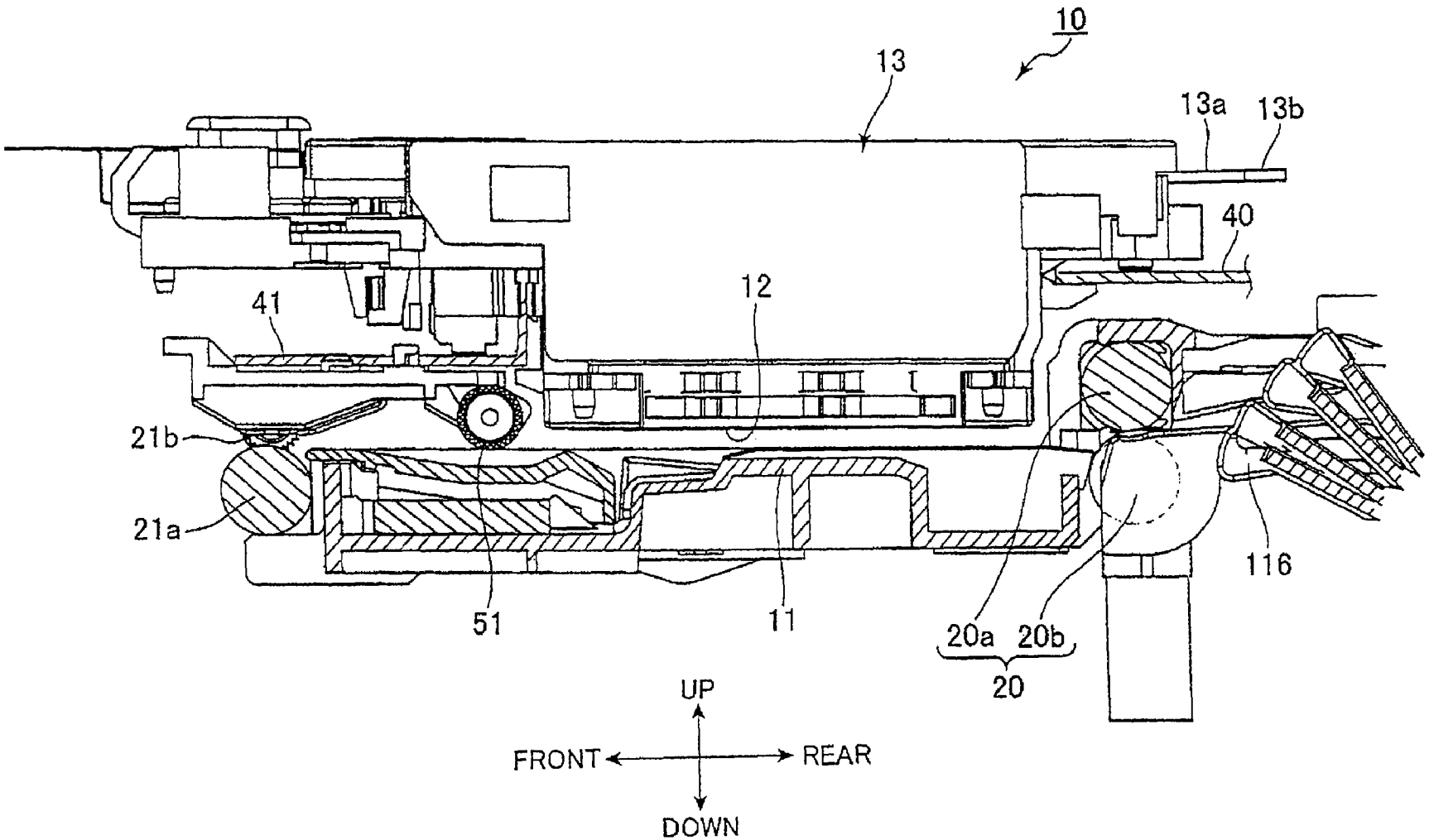
FIG. 5 is an enlarged side cross-sectional view showing an image-recording unit in FIG. 4.
Figure 7:
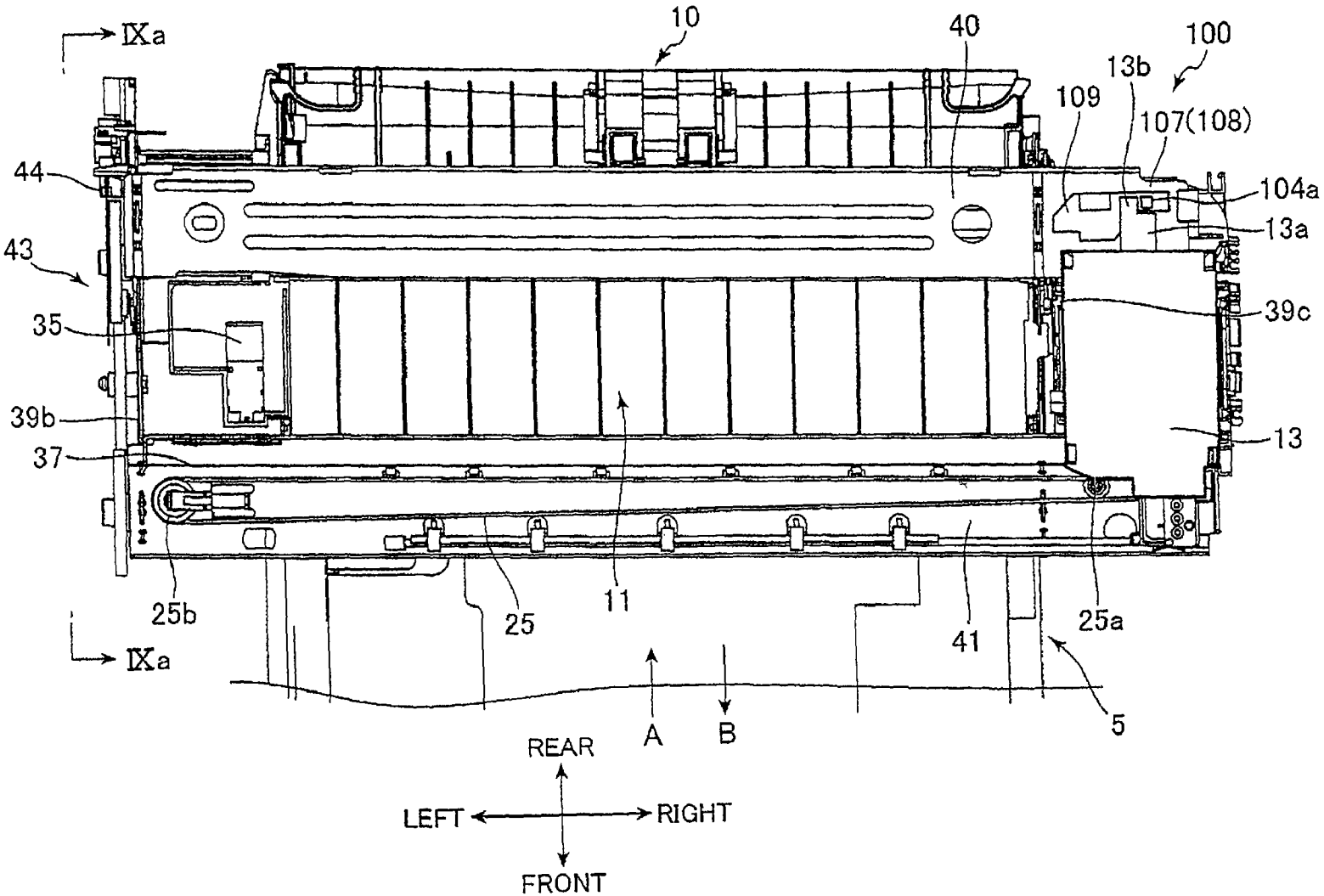
FIG. 7 is a plan view with a portion cut out showing the paper cassette mounted in the image-recording device.

As shown in FIG. 2, FIG. 3, and FIG. 4, the main casing 2 accommodates a feeding unit 6 having a feeding roller 7 disposed above the paper cassette 5; a conveying path having a U-shaped conveying section 9 disposed in the rear end of the main casing 2 for conveying the paper P substantially horizontally first in a rearward direction as indicated by an arrow A and then in a forward direction as indicated by an arrow B; and a recording unit 10 having an inkjet recording head 12 for ejecting ink onto a surface of the paper P over a platen 11 to record images on the paper P while the paper P is conveyed in the forward direction (arrow B). As shown in FIG. 5 and FIG. 7, the platen 11 is a plate-shaped supporting part disposed on the paper-conveying path.

As shown in FIG. 2 and FIG. 3, ink cartridges 26 are provided for supplying ink of different colors to the recording head 12 for color printing. The ink cartridges 26 are detachably mounted in an accommodating section 27 from above. The accommodating section 27 is positioned inside the main casing 2 near the inner surface of a side plate constituting the main casing 2 that is located farthest from another side plate having the rotating assembly. In this example, the ink cartridges 26 accommodate ink of the colors black, cyan, magenta, and yellow. Flexible ink tubes 28 connect the ink cartridges 26 to the recording head 12 for supplying ink to the recording head 12.

As shown in FIG. 2 through FIG. 5, the recording unit 10 is primarily configured of a carriage 13 supporting the recording head 12, the platen 11 formed of synthetic resin in a plate shape, a carriage motor 24 for driving the carriage 13 in a reciprocating motion, a timing belt 25 connected to the carriage motor 24, and an engine frame 39 formed of a metal plate for supporting these components. The carriage motor 24 is capable of rotating in a forward and reverse direction.

The engine frame 39 is disposed in the rear side of the main casing 2 above the paper cassette 5 and is formed of metal for providing support. As shown in FIG. 4, the engine frame 39 has a main body 39*a* of a box shape. A pair of guide plates 40 and 41 is mounted in the top side of the main body 39*a* and extend in the left-to-right direction (main scanning direction) of the main casing 2 for slidingly supporting the carriage 13 as shown in FIG. 2 and FIG. 3.

The guide plate 41 is disposed on the downstream side of the guide plate 40 in the paper-conveying direction. As shown in FIG. 7, the timing belt 25 extends in the main scanning direction (left-to-right direction) on the top surface of the guide plate 41 and is looped around pulleys 25*a* and 25*b*. The carriage 13 supporting the recording head 12 is coupled to a portion of the timing belt 25.

As shown in FIG. 7, a linear encoder (encoder strip) 37 is disposed on the top surface of the guide plate 41 and extends in the longitudinal direction (main scanning direction) for detecting the left-to-right position (position in the main scanning direction) and the direction of movement of the carriage 13. This strip-like linear encoder 37 has a detection surface, through which slits are formed at fixed intervals in the left-to-right direction. The strip-like linear encoder 37 is oriented, with its detection surface extending vertically.

As show in FIG. 4, a drive shaft 14 is rotatably fixed to the main body 39*a* of the engine frame 39. A feeding arm 6*a* of the feeding unit 6 is also rotatably fixed to the main body 39*a* of the engine frame 39.

Figure 6:
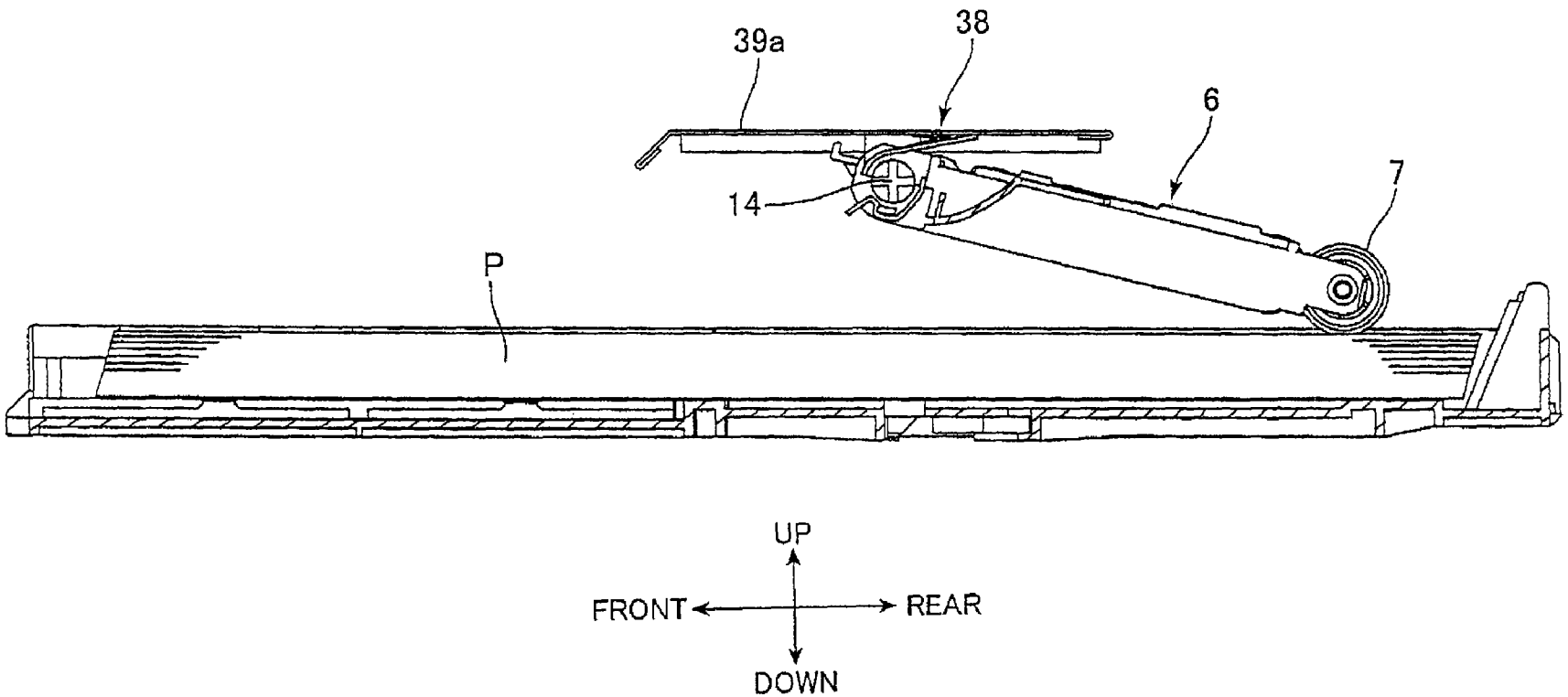
FIG. 6 is a side view of the paper cassette and a feeding unit.

As shown in FIG. 6, a torsion spring 38 is provided constantly urging the feeding arm 6*a* to pivot downward. As shown in FIG. 4, a gear transmission mechanism 50 is provided on the feeding arm 6*a* of the feeding unit 6 and configured of a plurality of interlocked gears that transmit a rotating force from the drive shaft 14 to the feeding roller 7.

The plate-shaped platen 11 is also disposed on the main body 39*a* for supporting the paper P at a position opposing the bottom surface of the recording head 12. As shown in FIG. 4 and FIG. 5, the area between the bottom surface of the recording head 12 and the platen 11 is referred to as the image-recording section.

As shown in FIG. 4 and FIG. 5, a pair of registration rollers 20 including a drive roller 20*a* and a follow roller 20*b* is disposed along the paper-conveying path on the upstream side of the platen 11 for conveying the paper P to the image-recording section along the bottom surface of the recording head 12. A pair of discharge rollers 21 configured of a drive roller 21*a* and spur rollers 21*b* is disposed along the paper-conveying path on the downstream side of the platen 11 for conveying the paper P to a discharge section in a direction indicated by the arrow B after an image has been recorded on the paper P.

As shown in FIG. 5, a sheet of paper P conveyed as described above is gripped between the drive roller 20*a* positioned on the top surface side and the follow roller 20*b* positioned on the bottom surface side. Further, the discharge rollers 21 grip the paper P with the drive roller 21*a* contacting the bottom surface of the paper P and the spur rollers 21*b* contacting the top surface of the paper P.

Figure 8:
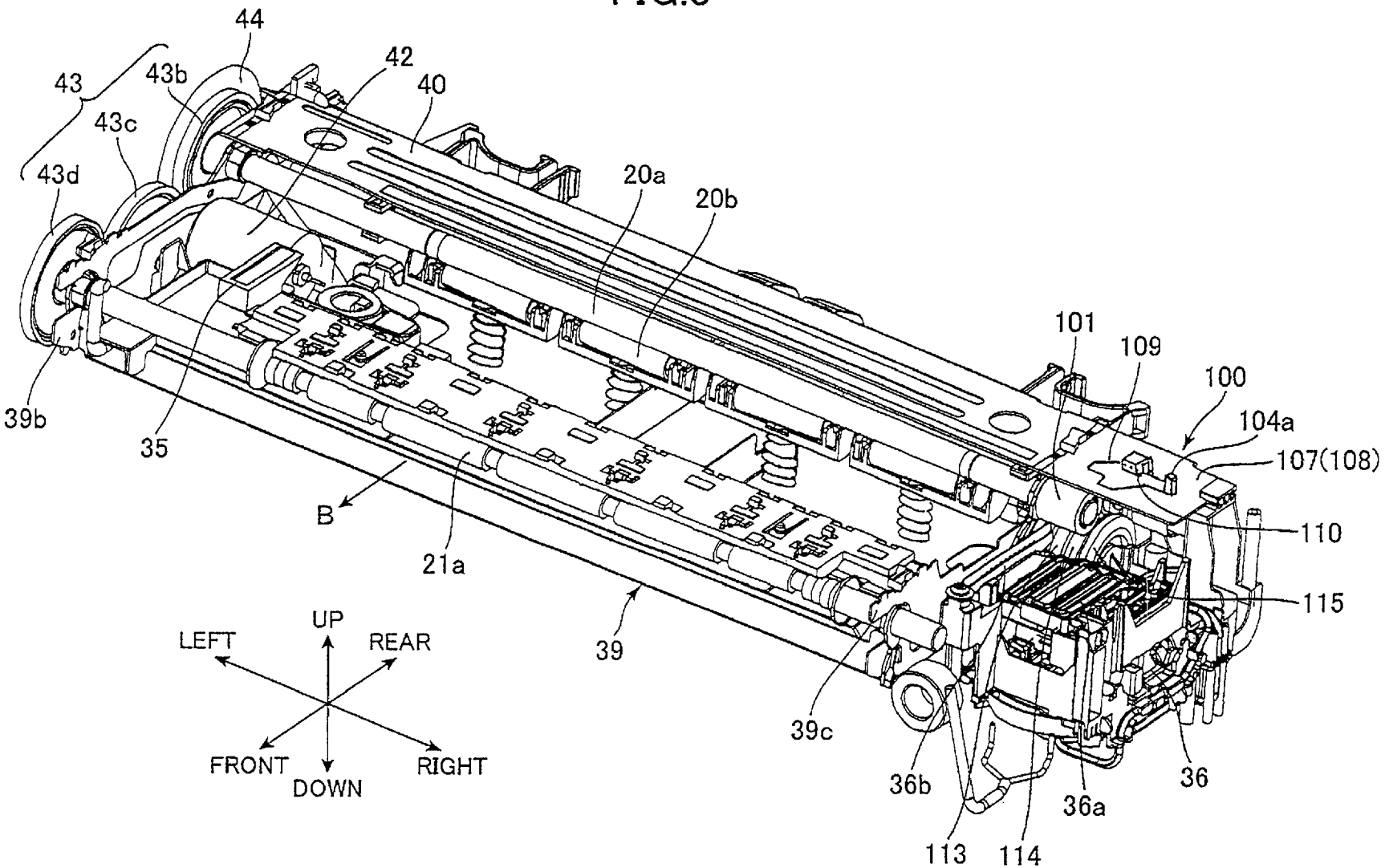
FIG. 8 is a perspective view of the image-recording unit without a downstream side guide plate, platen, and carriage.

As shown in FIG. 8, both ends of the drive roller 20*a* and both ends of the drive roller 21*a* are rotatably supported in shaft supporting parts provided in a pair of side plates 39*b* and 39*c* constituting the engine frame main body 39*a*.

As shown in FIG. 3, FIG. 7, and FIG. 8, an ink receiving unit 35 is disposed in the left side end of the main casing 2 outside the width dimension of the paper P conveyed along the conveying path (a position near the left side plate 39*b*), and a maintenance section 36 is disposed on the right side of the main casing 2 outside the width of the paper P (a region near the right side plate 39*c*). With this construction, the recording head 12 is periodically operated at a flushing position over the ink receiving unit 35 to eject ink for preventing clogging of the nozzles. The ejected ink is received in the ink receiving unit 35.

As shown in FIG. 8, a single common drive motor (linefeed motor) 42 is disposed near the left side plate 39*b*. The linefeed motor 42 is capable of rotating forward and in reverse. In this example, the linefeed motor 42 is a DC motor that produces a rotational force. The driving force from the linefeed motor 42 is transmitted to the drive roller 20*a*, drive roller 21*a*, and maintenance section 36 via a gear transmission mechanism 43.

Figure 9A:
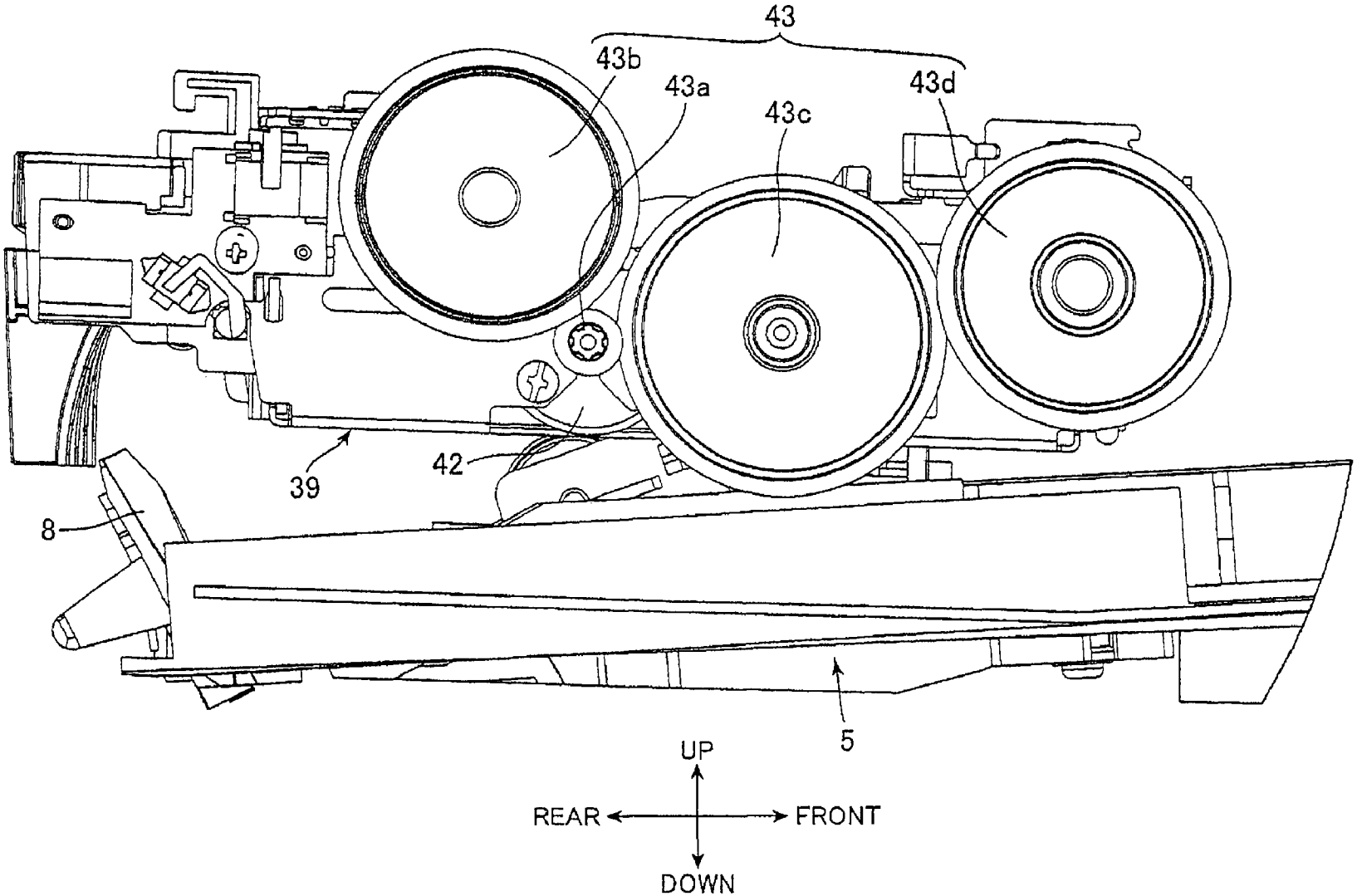
FIG. 9A is an enlarged cross-sectional view taken along the line IXa-IXa in FIG. 7.

As shown in FIG. 8 and FIG. 9A, the gear transmission mechanism 43 includes a pinion 43*a* mounted on a drive shaft of the linefeed motor 42; a transmission gear 43*b* and an intermediate gear 43*c* engaged to the rear and front sides of the pinion 43*a*; and a transmission gear 43*d* engaged with the intermediate gear 43*c*. The transmission gear 43*d* is mounted on the left end of the drive roller 21*a*. The transmission gear 43*b* is mounted on the left end of the drive roller 20*a*. A single long drive gear 101 is provided on the right end of the drive roller 20*a*. The transmission gear 43*b* and the drive gear 101 rotate integrally with the drive roller 20*a*.

As shown in FIG. 7 and FIG. 8, a rotary encoder 44 is provided in a portion of the gear transmission mechanism 43 for detecting a conveying amount that the roller pair 20 conveys the paper P.

Figure 9B:
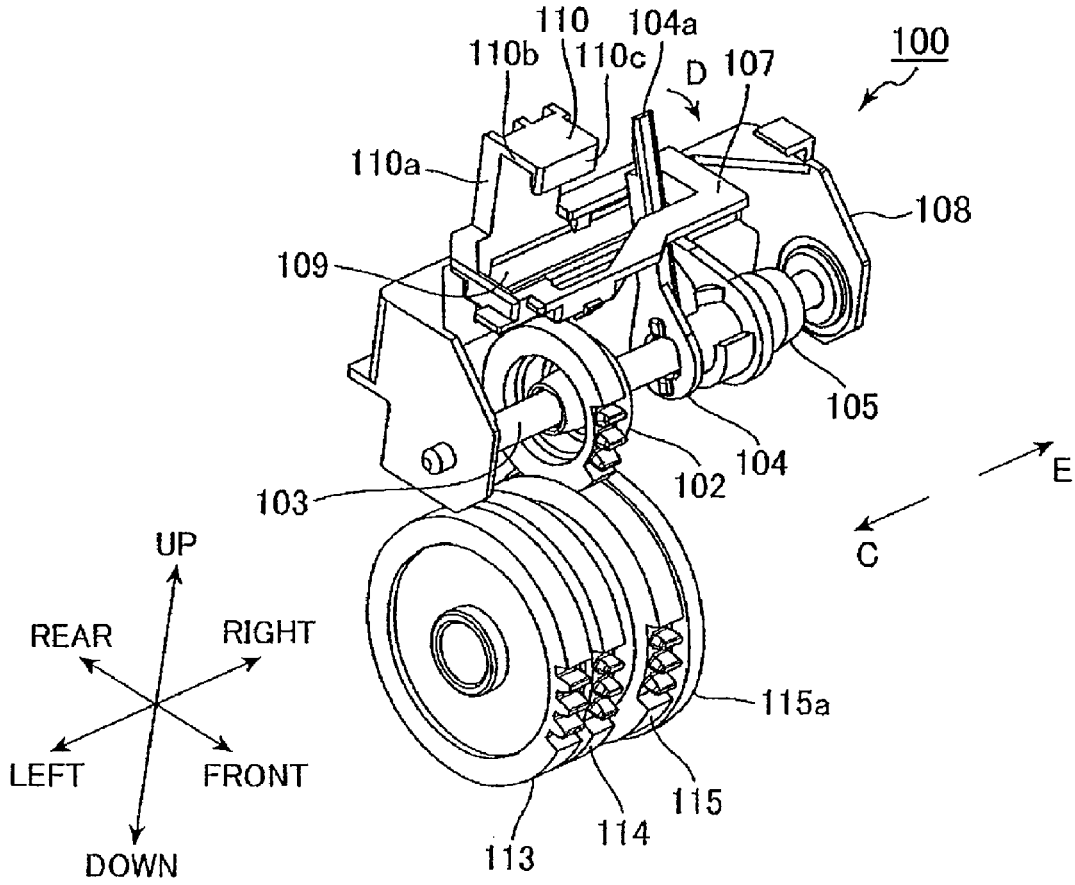
FIG. 9B is a perspective view of a drive transmission switching device.

As shown in FIG. 8 and FIG. 9B, an intermittent feeding transmission gear 113, a continuous feeding transmission gear 114, and a maintenance transmission gear 115 are rotatably mounted on the rear side of the maintenance section 36, with their rotational axes being in alignment with one another and being in parallel with the left-to-right direction. The intermittent feeding transmission gear 113, the continuous feeding transmission gear 114, and the maintenance transmission gear 115 are located on the lower-and-rear side of the drive gear 101. The rotational axes of the gears 113, 114, and 115 are parallel with the rotational axis of the drive gear 101. The entire length of the drive gear 101 along its rotational axis (left-to-right direction) covers the entire length of the intermittent feeding transmission gear 113, the continuous feeding transmission gear 114, and the maintenance transmission gear 115 along their rotational axes (left-to-right direction) (see FIG. 10). The intermittent feeding transmission gear 113, the continuous feeding transmission gear 114, and the maintenance transmission gear 115 are all spur gears, but the maintenance transmission gear 115 has a large-diameter bevel gear 115*a* (FIG. 10) integrally provided on the right side surface thereof for rotating together with the maintenance transmission gear 115. Although teeth are shown only on a part of the entire periphery of each gear 113, 114, and 115 in FIG. 9B, teeth are formed on the entire periphery of each gear 113, 114, 115.

As will be described later with reference to FIG. 12A, the intermittent feeding transmission gear 113 is coupled with a gear on the drive shaft 14 via two intermediate gears 119*a* and 119*b*. Contrarily, as will be described later with reference to FIG. 13A, the continuous feeding transmission gear 114 is coupled to the gear on the drive shaft 14 via a single intermediate gear 120. The maintenance transmission gear 115 is coupled to a maintenance mechanism (not shown) provided the maintenance section 36 for activating a suction pump (not shown) in the maintenance section 36.

As shown in FIG. 8, a drive transmission switching device 100 is disposed above the maintenance section 36. The drive transmission switching device 100 functions to transmit the rotational force from the linefeed motor 42 via the drive roller 20*a* and the drive gear 101 to either the feeding roller 7 of the feeding unit 6 or the maintenance mechanism in the maintenance section 36 via a selected one of the gears 113, 114, and 115.

As shown in FIG. 5, a paper sensor 116 is disposed upstream of the registration rollers 20 in the conveying direction. The paper sensor 116 is positioned downstream of the U-shaped conveying section 9 in the conveying direction. The paper sensor 116 is for detecting the leading and trailing edges of the paper P when the paper P is fed via the U-shaped conveying section 9 toward the image-recording section. The paper sensor 116 is a mechanical actuator, and pivots when the paper sensor 116 is contacted by a sheet of paper. Although not shown in FIG. 5, a registration sensor 117 (FIG. 15) working in conjunction with the paper sensor 116 is disposed also upstream of the registration rollers 20 in the conveying direction. The registration sensor 117 is an optical sensor that detects changes in the received light when the paper sensor 116 moves and blocks the light.

As described above, the drive roller 20*a* and the drive roller 21*a* are disposed one above and one below the paper-conveying path. When the linefeed motor 42 is driven to rotate in a prescribed direction, the drive roller 20*a* and drive roller 21*a* rotate in opposite directions from each other.

As shown in FIG. 5, spur rollers 51 are disposed downstream of the image-recording region formed by the nozzle surface of the recording head 12. The spur rollers 51 are disposed in a region between the discharge rollers 21 and the image-recording region. The spur rollers 51 are located near the top surface of the platen 11. With this construction, the paper P does not rise up after image recording and does not slide in contact with the nozzle surface, thereby preventing a decline in image quality.

Next, the structure of the drive transmission mechanism for transmitting a driving force from the linefeed motor 42 to the feeding unit 6 and maintenance section 36, and the drive transmission switching device 100 will be described with reference to FIG. 5 and FIG. 7 through FIG. 13C.

The drive transmission switching device 100 functions to switch the drive transmission mode to a maintenance mode for transmitting a driving force to only the maintenance section 36, and the intermittent feeding mode and continuous feeding mode for transmitting a driving force to the feeding roller 7 in the feeding unit 6.

As described above, a rotational force is transferred from the linefeed motor 42 to the drive roller 20*a* of the registration rollers 20 via the transmission gear (speed reduction gear) 43*b*.

As shown in FIG. 8 and FIG. 9A, the drive transmission switching device 100 is located to the right side of the guide plate 40, to the rear side of the drive gear 101, and to the upper-and-rear side of the intermittent feeding transmission gear 113, continuous feeding transmission gear 114, and maintenance transmission gear 115.

As shown in FIG. 8 and FIG. 9B, the drive transmission switching device 100 includes a switching-device frame 108 which is secured to the engine frame 39 on the right side of the guide plate 40. The switching-device frame 108 has a plate-shaped guiding block 107 in its upper part. The guiding block 107 has a guide through-hole 109 therein.

As shown in FIG. 9B, the switching-device frame 108 supports a support shaft 103 below the plate-shaped guiding block 107. The support shaft 103 extends in the left-to-right direction. Thus, the support shaft 103 extends parallel to the rotational axes of the drive roller 20*a*, the drive gear 101, the intermittent feeding transmission gear 113, continuous feeding transmission gear 114, and maintenance transmission gear 115.

A single switching gear 102 is slidably supported on the support shaft 103. The switching gear 102 is a spur gear. Although teeth are shown only on a part of the periphery of the gear 102 in FIG. 9B and FIG. 9C, teeth are formed on the entire periphery of the gear 102.

Figure 10:
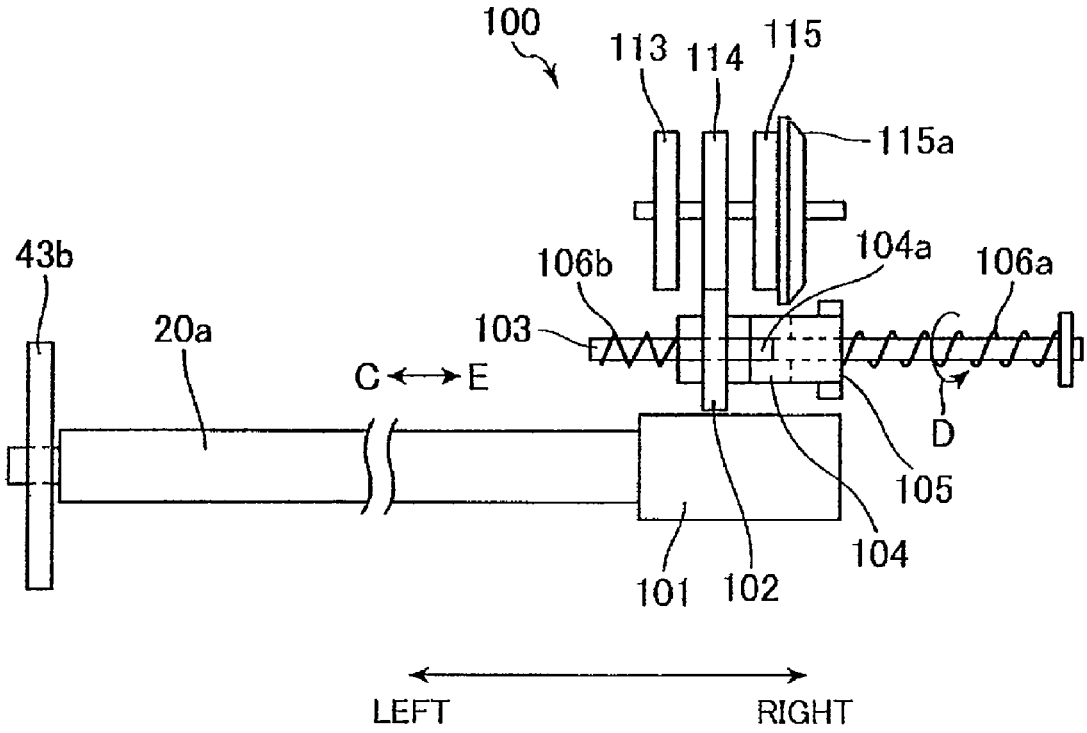
FIG. 10 is an illustration showing how a switching gear of the drive transmission switching device is engaged with a drive gear and a selected one of an intermittent feeding transmission gear, a continuous feeding transmission gear, and a maintenance transmission gear.

Although not shown in FIG. 9B, the switching gear 102 is constantly engaged with the drive gear 101 that is mounted on the right end of the drive roller 20*a* (FIG. 10). The switching gear 102 serves to transfer the rotational force of the drive roller 20*a* to a selected one of the intermittent feeding transmission gear 113, the continuous feeding transmission gear 114, and the maintenance transmission gear 115. More specifically, the switching gear 102 can engage with either one of the intermittent feeding transmission gear 113, the continuous feeding transmission gear 114, and the maintenance transmission gear 115 as the switching gear 102 slides along the support shaft 103.

FIG. 10 is a brief illustration showing how the switching gear 102 is engaged with the drive gear 101, the intermittent feeding transmission gear 113, the continuous feeding transmission gear 114, and the maintenance transmission gear 115. The switching gear 102 is constantly engaged with the drive gear 101 regardless of the position of the switching gear 102 along the support shaft 103. The switching gear 102 is engaged with either one of the intermittent feeding transmission gear 113, the continuous feeding transmission gear 114, and the maintenance transmission gear 115 dependently on the location of the switching gear 102 along the support shaft 103.

As shown in FIG. 9B, a first block 104 is slidably and rotatably fitted over the support shaft 103. The first block 104 is located on the right side of the switching gear 102. The first block 104 has an upward extending contact piece 104*a*. The upper distal end of the contact piece 104*a* penetrates through the guide through-hole 109 of the plate-shaped guiding block 107 vertically from below. A second block 105 is slidably fitted on the support shaft 103 at a location adjacent to the first block 104. The second block 105 is located on the right side of the first block 104. The first block 104 can contact to and separate from the switching gear 102.

Although not shown in FIG. 9B, a first urging spring 106*a* is fitted over the support shaft 103 in the right side of the second block 105 as shown in FIG. 10. The first urging spring 106*a* constantly urges the second block 105 in the leftward direction C indicated in FIG. 10. A second urging spring 106*b* is also fitted over the support shaft 103 on the left side of the switching gear 102. The second urging spring 106*b* constantly urges the switching gear 102 in the rightward direction E indicated in FIG. 10. In this example, the urging force of the spring 106*a* is set greater than that of the spring 106*b*.

Figure 9C:
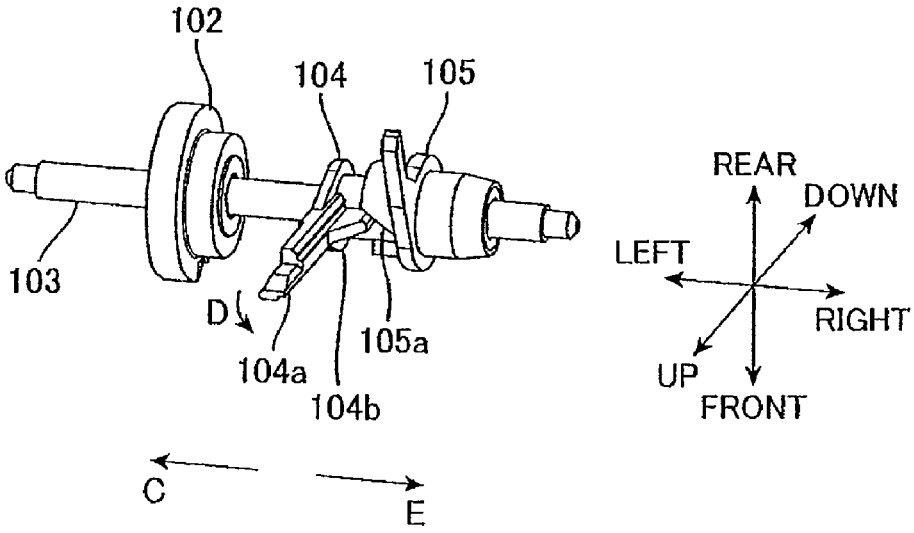
FIG. 9C shows how a switching gear, a first block, and a second block are arranged on a support shaft in the drive transmission switching device of FIG. 9B.

As shown in FIG. 9C, an endface cam part 104*b* and an endface cam part 105*a* are formed on the opposing surfaces of the first block 104 and second block 105, respectively. The endface cam part 105*a* is slanted relative to the axis of the support shaft 103. With this configuration, when the second block 105 presses the first block 104 in the leftward direction C, the first block 104 with the contact piece 104*a* rotates in a frontward direction D indicated in FIG. 10.

As shown in FIG. 5 and FIG. 7, a first engaging stepped portion 13*a* protrudes rearwardly from the rear surface of the carriage 13. A second engaging stepped portion 13*b* protrudes rearwardly from the rear surface of the first engaging stepped portion 13*a*. When the carriage 13 is positioned on the right-side end of the image-recording device 1 and above the maintenance section 36 as shown in FIG. 7, the first and second engaging stepped portions 13*a* and 13*b* are located above the plate-shaped guiding block 107 of the drive transmission switching device 100.

Figure 11A:
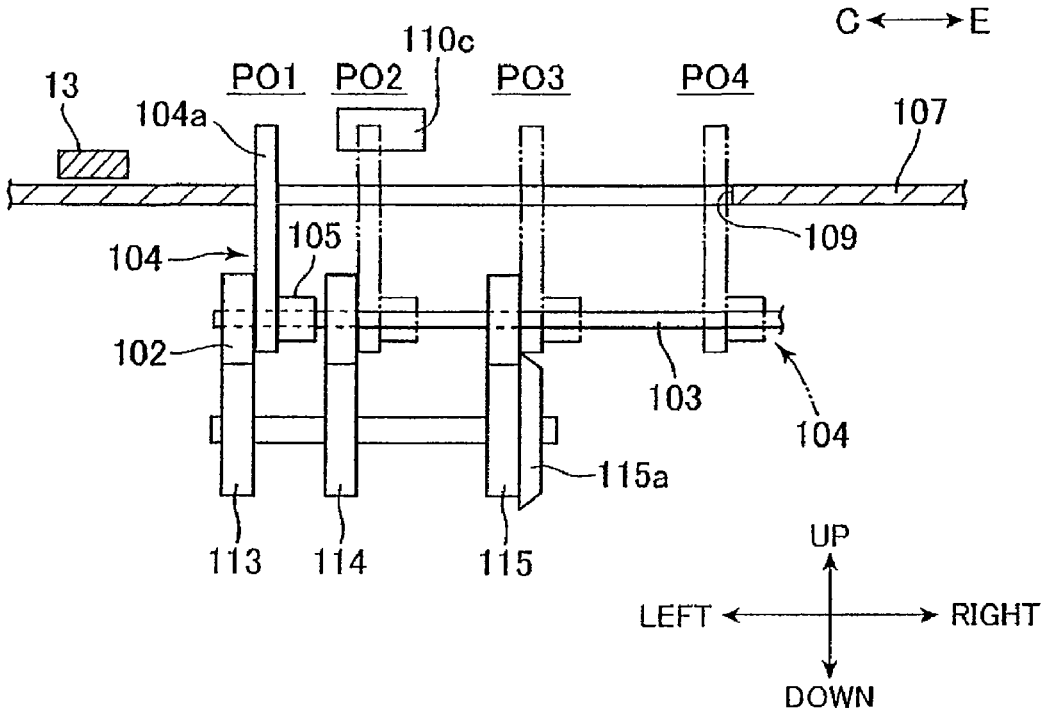
FIG. 11A is a front view showing the drive transmission switching device switched to each mode.
Figure 11B:
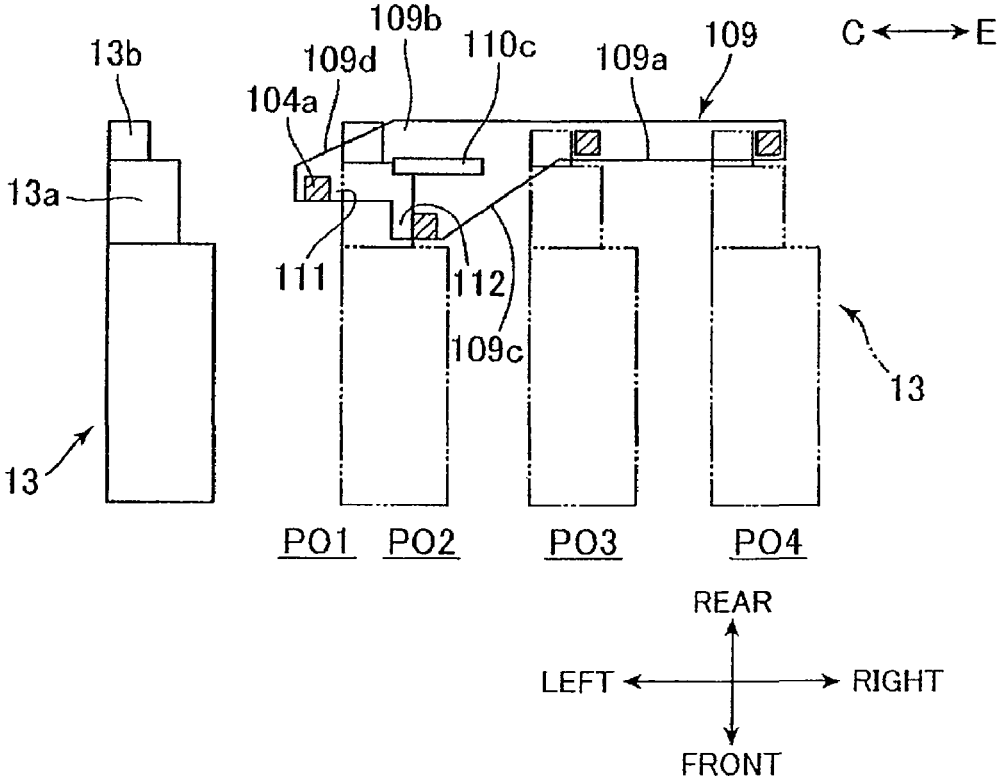
FIG. 11B is a plan view showing the drive transmission switching device switched to each mode.

With this configuration, when the carriage 13 is positioned on the right-side end of the image-recording device 1 and above the maintenance section 36, as shown in FIG. 11B, the carriage 13 receives, on either the first engaging stepped portion 13*a* or the second engaging stepped portion 13*b*, the contact piece 104*a* of the first block 104 that protrudes upwardly through the guide through-hole 109 of the plate-shaped guiding block 107. Thus, as the carriage 13 moves in the left-to-right direction, the contact piece 104*a* slides within the guide through-hole 109 in the leftward direction or in the rightward direction. As a result, the first block 104, the switching gear 102, and the second block 105 slide over the support shaft 103 in the leftward direction or in the rightward direction as the carriage 13 moves in the leftward direction or in the rightward direction.

As shown in FIG. 11B, the guide through-hole 109 of the plate-shaped guiding block 107 includes a straight groove part 109*a* extending in the left-to-right direction, and a wide groove part 109*b* that is wider than the straight groove part 109*a* in the front-to-rear direction and that is in communication with the left end of the straight groove part 109*a*. A step-like first setting part 111 and a step-like second setting part 112 are provided on the front part of the wide groove part 109*b*. The plate-shaped guiding block 107 has a front-right-side sloped edge 109*c* on the front-right side edge of the wide groove part 109*b* in continuation with the front edge of the straight groove part 109*a*, and a rear-left-side sloped edge 109*d* on the rear-left side edge of the wide groove part 109*b*.

As shown in FIG. 9B, the guiding block 107 has a restricting piece 110. The restricting piece 110 has: a rising part 110*a* rising up from the rear edge of the guiding block 107 on the rear side of the wide groove part 109*b*; a forwardly-extending part 110*b* extending forwardly from the top end of the rising part 110*a* toward the position above the center region of the wide groove part 109*b*; and a downwardly-protruding part 110*c* extending downwardly from the front edge of the forwardly-extending part 110*b*. The downwardly-protruding part 110*c* extends downward as opposing the center region of the wide groove part 109*b*. As shown in FIG. 11B, the rear surface of the downwardly-extending part 110*a* is in line with the front side edge of the straight groove part 109*a*.

The forwardly-extending part 110*b* of the restricting piece 110 is located at a vertical level higher than the upper end of the contact piece 104*a*. The lower edge of the downwardly-protruding part 110*c* is located at a vertical level lower than the upper end of the contact piece 104*a*. So, the downwardly-protruding part 110*c* restricts the passage of the contact piece 104*a* so that the contact piece 104*a* can move along a circular path surrounding the downwardly-protruding part 110*c* in the wide groove part 109*b* as shown in FIG. 11B.

As shown in FIG. 11A and FIG. 11B, when the carriage 13 moves far away from the maintenance section 36 in the leftward direction C and reaches the recording region for the paper P, the first block 104 and switching gear 102 are moved along the support shaft 103 due to the second block 105 being pressed by the spring 106*a* in the leftward direction C. At this time, the contact piece 104*a* of the first block 104 becomes positioned in the first setting part 111. This position is referred to as position 1 (Po1). At this time, the switching gear 102 is engaged with the intermittent feeding transmission gear 113.

Next, when the carriage 13 moves toward the maintenance section 36 in the rightward direction E, the first engaging stepped portion 13*a* of the carriage 13 presses against the contact piece 104*a*. When the contact piece 104*a* is positioned in the second setting part 112 (referred to as position 2, or Po2), the switching gear 102 is brought into engagement with the continuous feeding transmission gear 114.

After the carriage 13 subsequently moves farther in the rightward direction E, the first engaging stepped portion 13*a* continues to push the contact piece 104*a* toward the straight groove part 109*a* along the front-right-side sloped edge 109*c* of the wide groove part 109*b*. When the contact piece 104*a* enters the left end portion of the straight groove part 109*a*

(referred to as position 3, or Po3), the contact piece 104*a* becomes engaged with the second engaging stepped portion 13*b* of the carriage 13. At this time, the switching gear 102 is brought into engagement with the maintenance transmission gear 115.

When the carriage 13 moves farther in the rightward direction E from the position 3 (Po3), the switching gear 102 is brought into abutment contact with the left side surface of the bevel gear 115*a* and is prevented from moving farther in the rightward direction E. Therefore, the first block 104 separates from the switching gear 102, and the switching gear 102 remains engaged with the maintenance transmission gear 115. The contact piece 104*a* is further pushed by the second engaging stepped portion 13*b* of the carriage 13 to a position at the right end of the straight groove part 109*a*. This is position 4 (Po4) and is referred to as the home position (position of origin).

When the carriage 13 moves in reverse, that is, in the leftward direction C from position 4 (Po4) and the contact piece 104*a* shifts from the straight groove part 109*a* to the wide groove part 109*b*, the second engaging stepped portion 13*b* remains receiving the contact piece 104*a* and prevents the contact piece 104*a* from sliding along the front-right-side sloped edge 109*c*. Therefore, the contact piece 104*a* moves leftward while sliding along the rear side surface of the restricting piece 110, and subsequently slides along the rear-left-side sloped edge 109*d* of the wide groove part 109*b* into the left end of the wide groove part 109*b*, shown in FIG. 11B. In this way, the contact piece 104*a* can move in a cycle and once again engage in the first setting part 111.

Position 3 (Po3) is used both as a standby position and a maintenance position. In this position, a cap part 36*a* of the maintenance section 36 covers the bottom nozzle surface of the recording head 12. In this maintenance position, a recovery process and the like are performed by driving the linefeed motor 42, and by transmitting the driving force of the linefeed motor 42 via the switching gear 102 and the maintenance transmission gear 115 to activate the suction pump (not shown) to selectively draw ink from the nozzles in the recording head 12 and to remove air bubbles from a buffer tank (not shown) in the recording head 12. When the carriage 13 is moved leftward in FIG. 8 from the maintenance section 36 to the image-recording region, a cleaner 36*b* (wiper blade) of the maintenance section 36 wipes the nozzle surface of the recording head 12.

When the power to the image-recording device 1 is not turned on, the carriage 13 is halted in a position over the top surface of the maintenance section 36 (Po3), at which time the cap part 36*a* on the top surface of the maintenance section 36 covers and hermetically seals the nozzles in the recording head 12 (see FIG. 8). The nozzles are also covered and hermetically sealed by the cap part 36*a* in the home position (Po4).

Figure 12A:
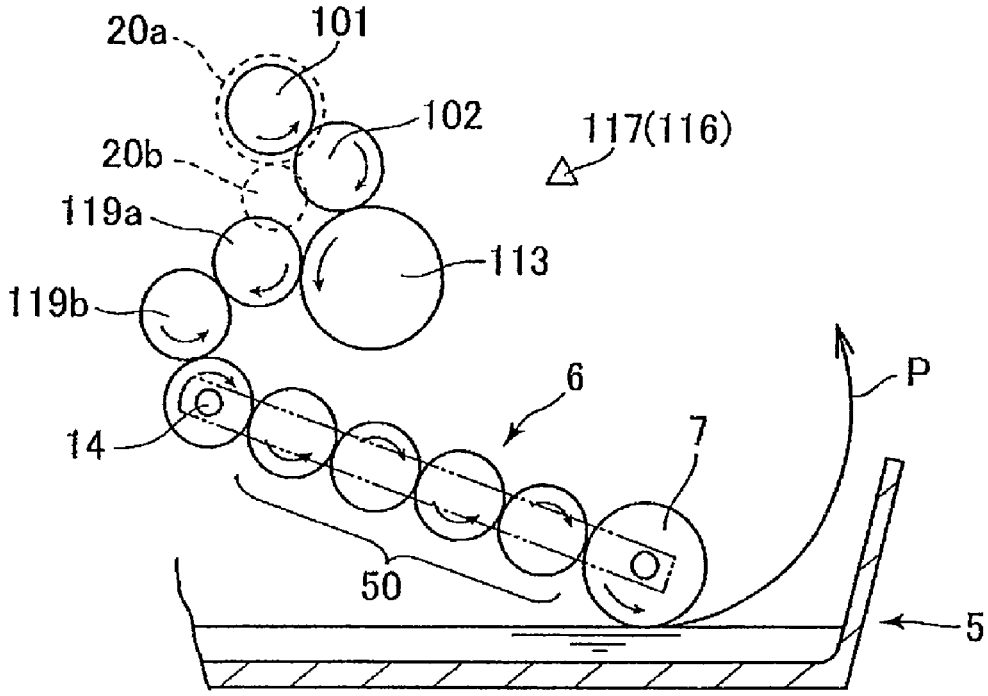
FIG. 12A is an explanatory diagram illustrating the drive transmission when feeding paper in the intermittent feeding mode.
Figure 12B:
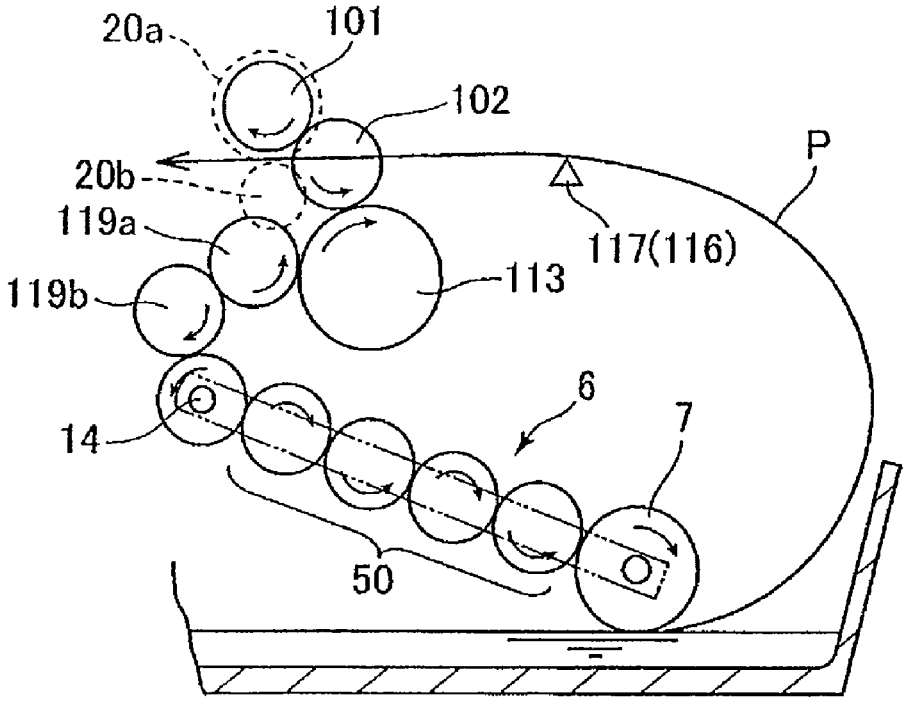
FIG. 12B is an explanatory diagram illustrating the drive transmission when recording an image in the intermittent feeding mode.

As shown in FIG. 12A and FIG. 12B, the intermittent feeding transmission gear 113 is coupled with the drive shaft 14 on the base end of the feeding arm 6*a* via the two intermediate gears 119*a* and 119*b*. At position 1 (Po1) in which the switching gear 102 is engaged with the intermittent feeding transmission gear 113, a driving force is transmitted from the drive roller 20*a* to the drive shaft 14 via the intermittent feeding transmission gear 113 and the intermediate gears 119*a* and 119*b*. This driving force rotates the feeding roller 7 via the gear transmission mechanism 50.

Figure 13A:
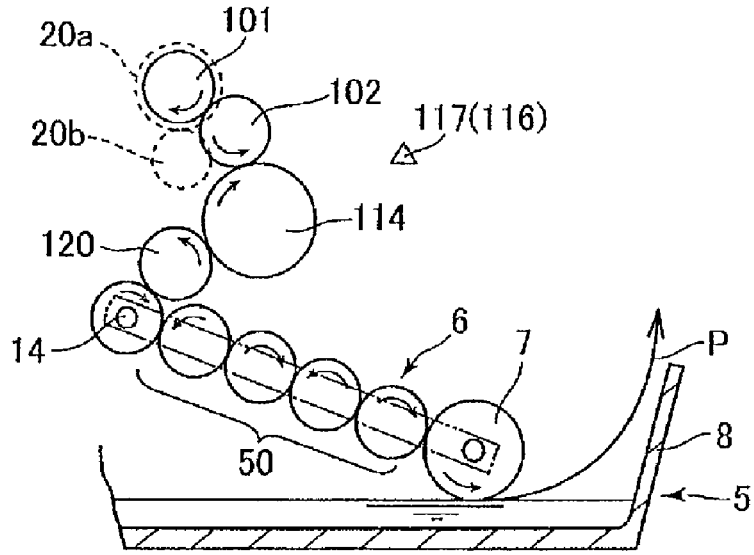
FIG. 13A is an explanatory diagram showing the drive transmission during feeding paper in the continuous feeding mode.
Figure 13B:
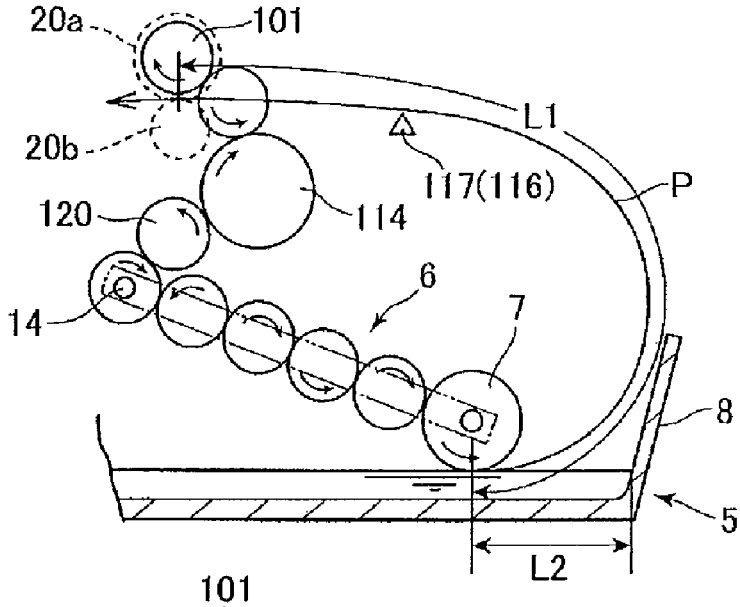
FIG. 13B is an explanatory diagram showing the drive transmission during recording an image in the continuous feeding mode.
Figure 13C:
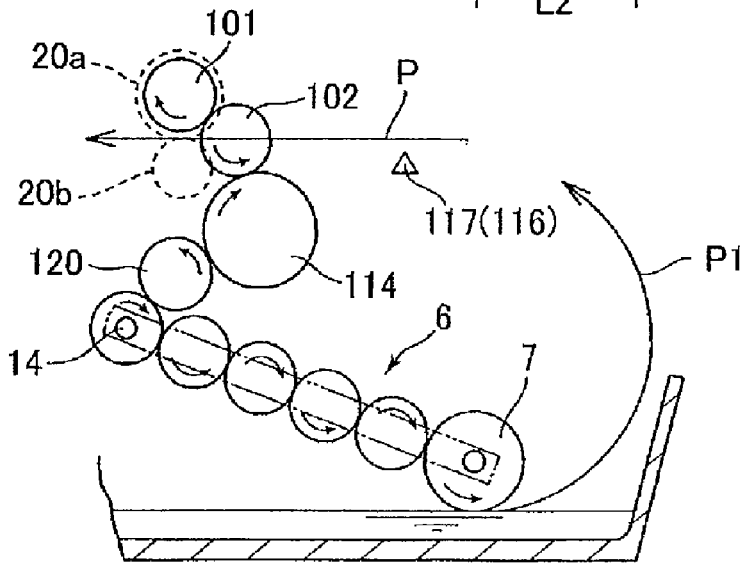
FIG. 13C is an explanatory diagram showing the drive transmission when feeding a succeeding sheet of paper in the continuous feeding mode.

As shown in FIG. 13A through FIG. 13C, the continuous feeding transmission gear 114 is coupled to the drive shaft 14 via the single intermediate gear 120. Hence, in position 2 (Po2) in which the switching gear 102 is engaged with the continuous feeding transmission gear 114, a driving force is transmitted from the drive roller 20*a* to the drive shaft 14 via the continuous feeding transmission gear 114 and the intermediate gear 120. This driving force rotates the feeding roller 7 via the gear transmission mechanism 50.

Next, a controller of the image-recording device 1 will be described with reference to FIG. 15. The controller controls the overall operations of the image-recording device 1.

Figure 15:
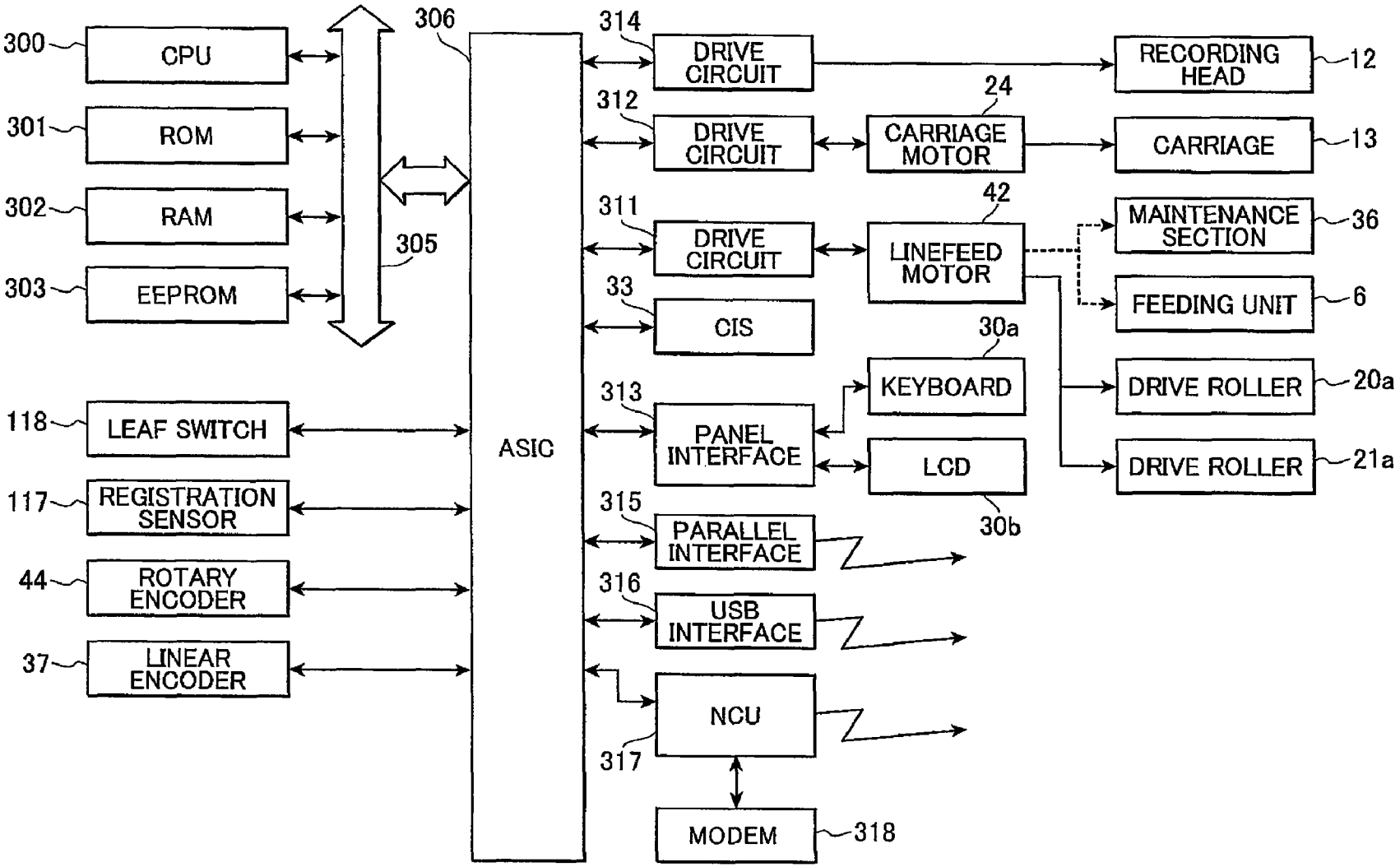
FIG. 15 is a block diagram showing a controller in the image-recording device.

As shown in FIG. 15, the controller is configured of a microcomputer primarily comprising a CPU 300, a ROM 301, a RAM 302, and an EEPROM 303. These components are connected to an application specific integrated circuit (ASIC) 306 via a bus 305.

The ROM 301 stores programs or the like for controlling various operations of the inkjet printer. The RAM 302 is used as a storage area or a work area for temporarily storing various data used by the CPU 300 when executing these programs.

The ASIC 306 is connected to a network control unit (NCU) 317. Communication signals received from a public telephone line via the NCU 317 are inputted into the ASIC 306 after being demodulated by a modem 318. When transmitting image data externally, as in facsimile transmissions, the ASIC 306 outputs communication signals to the public telephone line via the NCU 317 after the image data is first modulated into a communication signal by the modem 318.

Based on commands from the CPU 300, the ASIC 306 also generates a phase excitation signal or the like for powering the linefeed motor 42, for example. This signal is applied to a drive circuit 311 of the linefeed motor 42 or a drive circuit 312 of the carriage motor 24. In this way, a drive signal is transmitted to the linefeed motor 42 or the carriage motor 24 via the respective drive circuit 311 or drive circuit 312 for controlling the linefeed motor 42 or carriage motor 24 to rotate forward or in reverse, to halt, or the like.

The ASIC 306 is also connected to the scanning unit 33 (CIS, for example) for reading text or images on an original; a panel interface 313 including a keyboard 30*a*, and a liquid crystal display (LCD) 30*b* of the control panel 30 serving to perform transmission and reception operations; and a parallel interface 315, USB interface 316, and the like for exchanging data with a personal computer or other external device via a parallel cable, USB cable, or the like.

The ASIC 306 is also connected to a leaf switch 118 for detecting the rotated position of a cam (not shown) in the maintenance section 36; the registration sensor 117 disposed in association with the paper sensor 116; the rotary encoder 44 for detecting the amount of rotation in the drive roller 20*a*; and the linear encoder 37 for detecting the amount of movement and the movement position (current position) of the carriage 13 in the reciprocating direction.

A drive circuit 314 functions to selectively eject ink from the recording head 12 onto the paper P at a prescribed timing. The drive circuit 314 receives a signal generated and outputted from the ASIC 306 and drives the recording head 12 based on a drive control procedure outputted from the CPU 300.

Next, a paper-feeding operation and image-recording operation executed based on the controller described above will be described with reference to the flowchart in FIG. 16. Specifically, a control operation is performed to switch the feeding state of cut sheets of paper between a first mode and a second mode. In the first mode, paper is fed intermittently from the paper cassette 5 when recording images on a plurality of sheets. This mode gives priority to high-quality image recording. In the second mode, paper is fed continuously from the paper cassette 5 when recording a plurality of sheets.

This mode emphasizes high-speed recording. In this example, "mode" indicates an operating state that is maintained unless switched by the drive transmission switching device 100.

The control process begins when the power to the image-recording device 1 is turned on.

Figure 16:
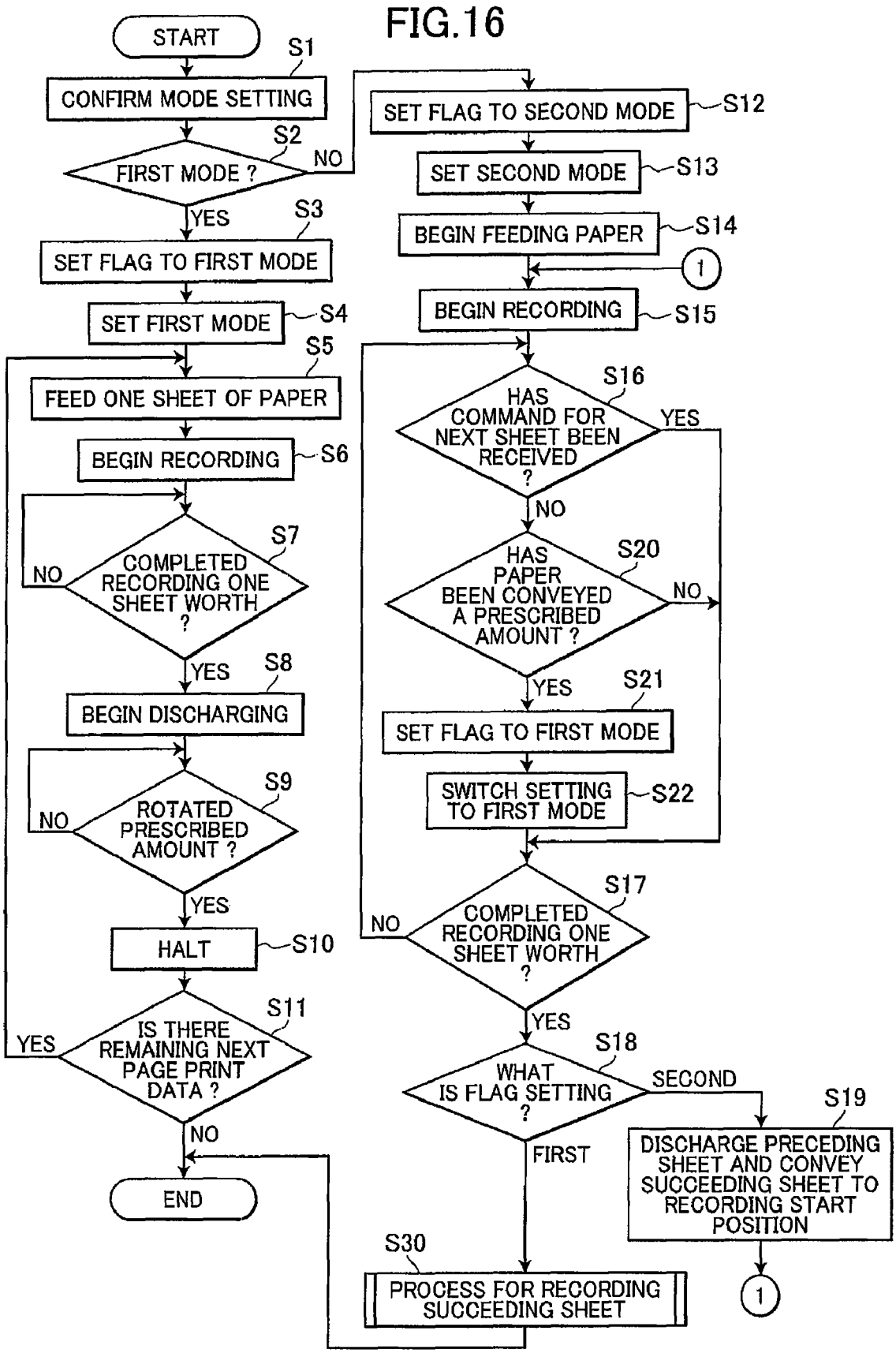
FIG. 16 is a flowchart illustrating steps in an image-recording operation.
Figure 17:
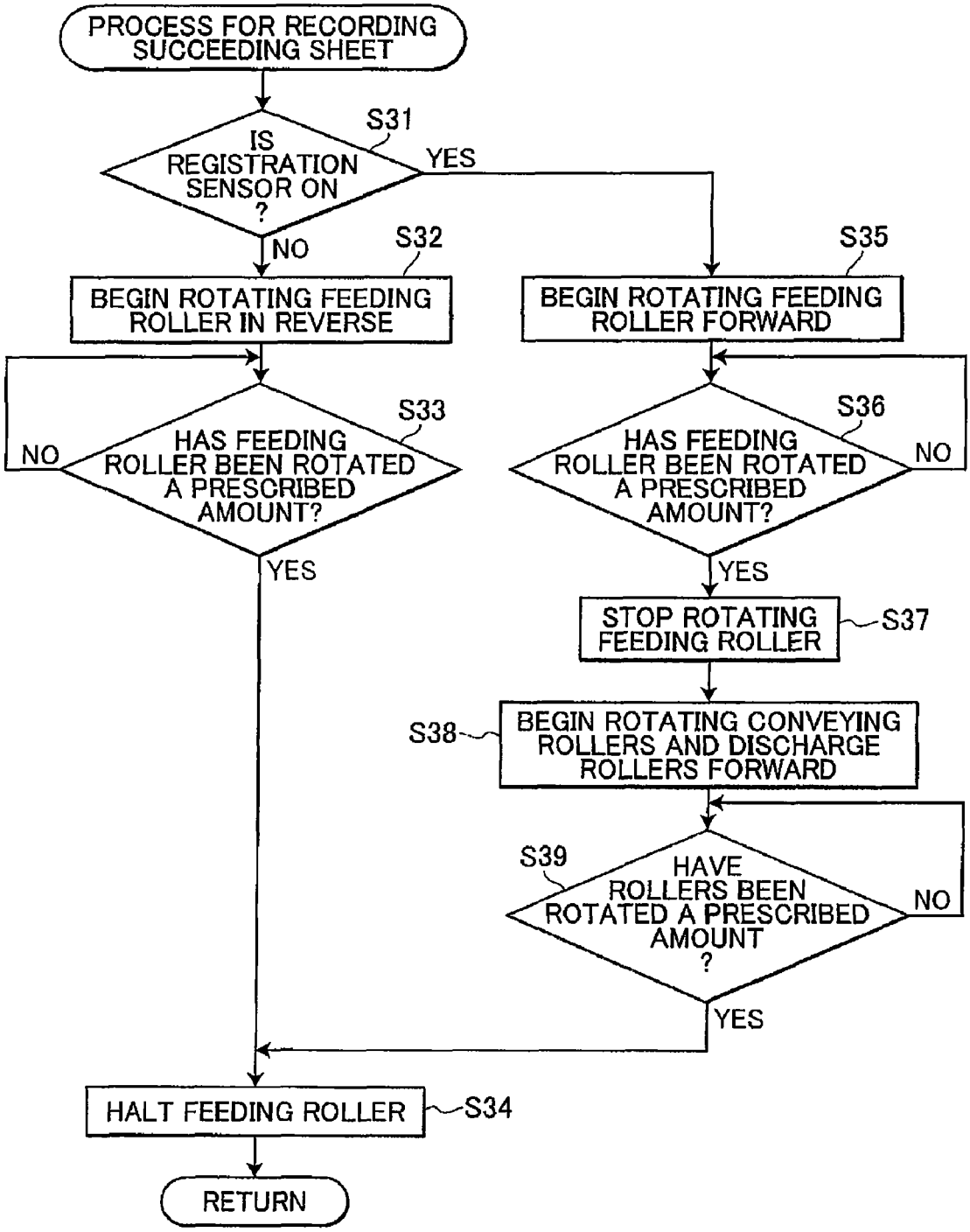
FIG. 17 is a flowchart illustrating steps in the paper-returning process performed in the continuous feeding mode.

First, in S1 of FIG. 16, the user selects either the first or second mode by pushing the mode setting button (not shown) in the control panel 30, and the controller confirms the selected mode. The first mode may be used for performing color printing of color photographs or the like by recording microdots of ink in a plurality of colors on the paper. In this case, a sheet of the paper P conveyed to the registration rollers 20 is temporarily halted when the leading edge of the paper P contacts the registration rollers 20 to remove any skew in the paper P and to align the conveyed position of the paper P with the printing position of the recording head. In this way, it is possible to print images on photo paper or the like without problems in color registration or irregularities in color tone.

In S2 the controller determines whether the selected mode is the first mode giving priority to precision (intermittent feeding mode). If the selected mode is the first mode (S2: YES), then in S3 the controller switches a flag to the first mode by storing a flag indicating the first mode in a prescribed region of the RAM 302.

In S4 the controller sets the drive transmission switching device 100 to the first mode. Consequently, the carriage 13 maintained in the standby position (Po3) is moved far in the leftward direction C toward the image-recording region as shown in FIG. 11B. As a result, the first block 104 urged by the spring 106*a* moves in the leftward direction C along the restricting piece 110 of the wide groove part 109*b*. When the carriage 13 separates from the wide groove part 109*b*, the contact piece 104*a* is received and maintained in the first setting part 111 (Po1). In this state, the switching gear 102 is engaged with the intermittent feeding transmission gear 113 and is coupled with the gear on the drive shaft 14 of the feeding unit 6 via the intermediate gears 119*a* and 119*b* so as to transmit a driving force to the drive shaft 14, as shown in FIG. 12A.

Then, in S5, the linefeed motor 42 is driven to rotate in reverse in this state. As a result, the drive roller 20*a* of the registration rollers 20 also rotates in reverse (counterclockwise in FIG. 12A). The feeding roller 7 is driven to rotate in a feeding direction (a forward direction; counterclockwise in FIG. 12A) via the gear transmission mechanism 50 in the feeding arm 6*a*. As a result, a plurality of sheets of the paper P stacked in the paper cassette 5 are fed against the large frictional separating member (not shown) disposed on the sloped separating surface 8 at the end of the paper cassette 5, resulting in only the topmost sheet of the paper P separating and being fed along the U-shaped conveying section 9. Since the drive roller 20*a* of the registration rollers 20 is rotating in reverse (counterclockwise in FIG. 12A) at this time, the leading edge of the paper P collides against the nip part between the follow roller 20*b* and the drive roller 20*a*, receiving a registration effect to correct any skew in the paper.

Next, as illustrated in FIG. 12B, the linefeed motor 42 is rotated forward a prescribed number of steps in order to rotate the drive roller 20*a* in the forward direction (clockwise in FIG. 12B) so that the paper P interposed between the follow roller 20*b* and drive roller 20*a* is conveyed below the recording head 12 (cuing operation). The cuing operation is performed to convey the paper P forward to set the leading edge of the paper P, which has already passed the paper sensor 116 and which is presently being gripped by the registration rollers 20, into a prescribed recording start position in the image-recording section. Image recording will be started on the sheet of paper P at the recording start position.

At this time, the feeding roller 7 rotates in reverse (clockwise in FIG. 12B), opposite the conveying direction. However, the paper P gripped by the registration rollers 20 slips along the peripheral surface of the feeding roller 7 because the nip force between the registration rollers 20 is set greater than the conveying force generated by the feeding roller 7 (a force in which the feeding roller 7 bites into the paper due to a force in which the feeding roller 7 presses against the paper by the urging of the torsion spring 38), causing a release effect in which the feeding arm 6*a* pivots upward about the drive shaft 14.

When an image-recording command is received from an external computer or the likes (not shown), in S6 the controller begins advancing the paper P by steps, and ejects ink from nozzles in the recording head 12 onto a surface of the paper P while reciprocating the carriage 13 in the main scanning direction. When the paper P is advanced intermittently, the registration rollers 20 and discharge rollers 21 rotate in the same direction (forward rotation), as illustrated in FIG. 12B. During a cuing operation or image recording, as illustrated in FIG. 12B, the drive shaft 14 is rotated in reverse, causing the feeding arm 6*a* to pivot upward and the feeding roller 7 to rotate in reverse (clockwise in FIG. 6).

After one sheet of paper P has been recorded (S7: YES), in S8 the controller begins discharging the recorded paper P. After the linefeed motor 42 has been rotated forward a prescribed number of steps for rotating the registration rollers 20 and discharge rollers 21 forward continuously (S9: YES), the linefeed motor 42 is halted in S10.

In S11 the controller determines whether there is image recording data for a successive sheet of paper (a next page). If there exists image recording data for the next page (S11: YES), the process in S5-S11 is repeated. In this way, it is possible to feed one sheet of paper P at a time to the image-recording section and to perform a precise image-recording process, as required for color photographs.

As described above, in position 1 (Po1) the contact piece 104*a* is urged in the leftward direction C by the spring 106*a* and maintained in the first setting part 111 as shown in FIG. 11B. Similarly, in position 2 (Po2) the contact piece 104*a* can be maintained in the second setting part 112, which is a step that is located on the front side of the first setting part 111. Accordingly, after temporarily holding the contact piece 104*a* in a prescribed position Po1 or Po2 in this way, the carriage 13 can be returned to the image-recording region and applied to an image recording operation. Therefore, the carriage 13 need not be moved to the drive transmission switching device 100, which is outside of the image-recording region, during each registration process, thereby speeding up the overall image-recording operation during the precision recording (intermittent feeding) mode.

On the other hand, in S2, if the controller determines that the selected mode is not the first mode (S2: NO), in S12 the controller sets the flag to the second mode by storing a flag indicating the second mode in a prescribed region of the RAM 302.

In S13 the controller sets the drive transmission switching device 100 to the second mode. The second mode gives priority to recording speed rather than image quality during the image recording operation. In order to convey a plurality of sheets of the paper P continuously from the paper cassette 5, the nip force at the nip point between the follow roller 20*b* and drive roller 20*a* is set greater than the conveying force of the feeding roller 7 for conveying the paper P in the paper cassette 5, and the peripheral velocity of the drive roller 20*a* is set greater than that of the feeding roller 7. These variables are set based on a reduction ratio of the continuous feeding transmission gear 114 and intermediate gear 120, for example.

More specifically, in S13, the carriage 13 halted in position 3 (Po3) described above is moved far in the leftward direction C toward the image-recording region to cause the contact piece 104*a* to reach position 1 (Po1) in the same manner as in the first mode described above. Then, the carriage 13 is moved backward in the rightward direction E. As a result, the first engaging stepped portion 13*a* of the carriage 13 presses the contact piece 104*a* to allow the contact piece 104*a* to enter the second setting part 112 (Po2). As a result, the switching gear 102 is engaged with the continuous feeding transmission gear 114. Even when the carriage 13 is subsequently moved in the leftward direction C (over the image recording region), the contact piece 104*a* is maintained on the lower second setting part 112 by the urging of the spring 106*a*.

In S14 the controller rotates the linefeed motor 42 forward in order to rotate the drive roller 20*a* forward (clockwise in FIG. 13A) and to rotate the feeding roller 7 forward (counterclockwise in FIG. 13A) in the feeding direction as shown in FIG. 13A. Consequently, the paper P is separated so that only one sheet of the paper P is conveyed along the U-shaped conveying section 9.

When the leading edge of the paper P reaches the nip part between the drive roller 20*a* and follow roller 20*b*, in S15 the controller controls the drive roller 20*a* and follow roller 20*b* to begin conveying the paper P below the recording head 12 as shown in FIG. 13B, without performing registration, and to begin recording images on the paper P. In the second mode, it is preferable to configure the ASIC 306 to refuse output signals (ON/OFF signals) from the registration sensor 117.

When a single sheet of the paper P is pinched at the nip part between the drive roller 20*a* and follow roller 20*b* and is gripped by the feeding roller 7 (in other words, when a sheet of paper P spans between both nip parts, as shown in FIG. 13B), the paper P can be reliably conveyed to the image-recording section by the drive roller 20*a* and follow roller 20*b* since the nip force between the drive roller 20*a* and follow roller 20*b* is greater than the conveying force of the feeding roller 7, and since the peripheral velocity of the drive roller 20*a* is set greater than that of the feeding roller 7, as described above.

Next, if a command indicating the existence of the next sheet (succeeding sheets of paper) has been received from the external device (S16: YES) and image recording has been completed on the present sheet P (S17: YES), in S18 the controller determines whether the current flag is set to the first mode or the second mode. If the flag is set to the second mode (S18: second), then the linefeed motor 42 is continuously driven to rotate forward, thereby rotating the drive roller 20*a*, drive roller 21*a*, and feeding roller 7 in a forward rotation. Accordingly, in S19 the present sheet of paper P is discharged, while the succeeding sheet P1 is conveyed to the recording start position as shown in FIG. 13C. Next, the controller returns to S15 to begin performing image recording on this succeeding sheet P1. In this way, a plurality of sheets of the paper can be fed and conveyed continuously without temporarily halting the sheets at the registration rollers 20, thereby achieving a high-speed image recording operation.

Next, steps in the control process for a succeeding sheet of paper in a continuous feeding operation (second mode) will be described with reference to FIG. 14A-FIG. 14D and FIG. 16 and FIG. 17 for the case in which no image recording data exists for the succeeding sheet.

Figure 14A:
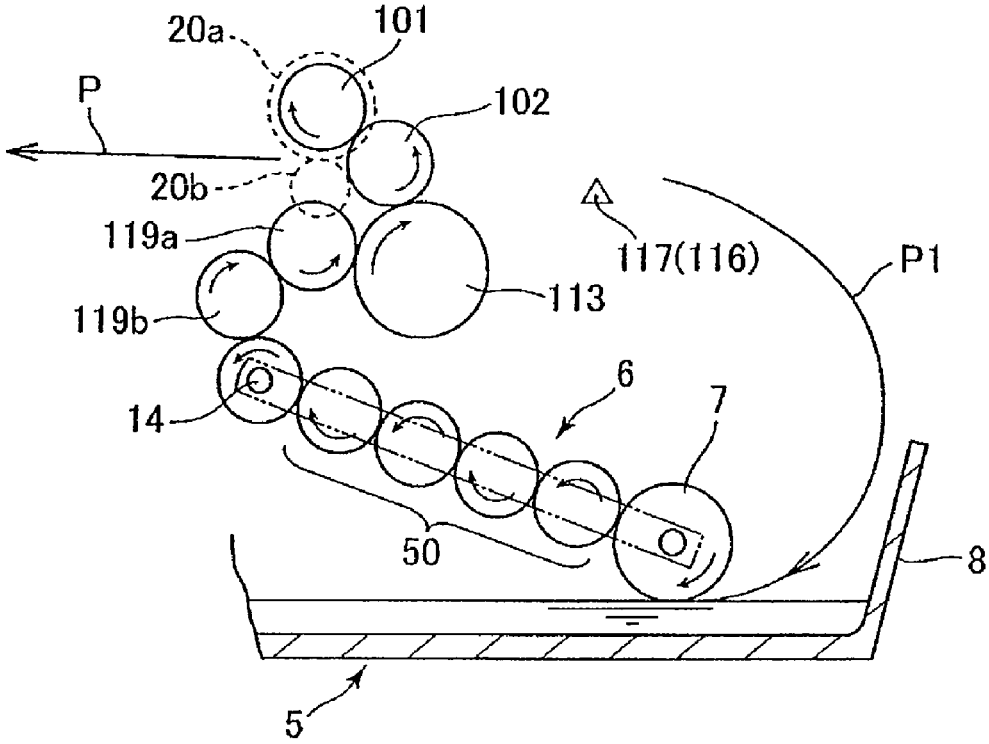
Figure 14B:
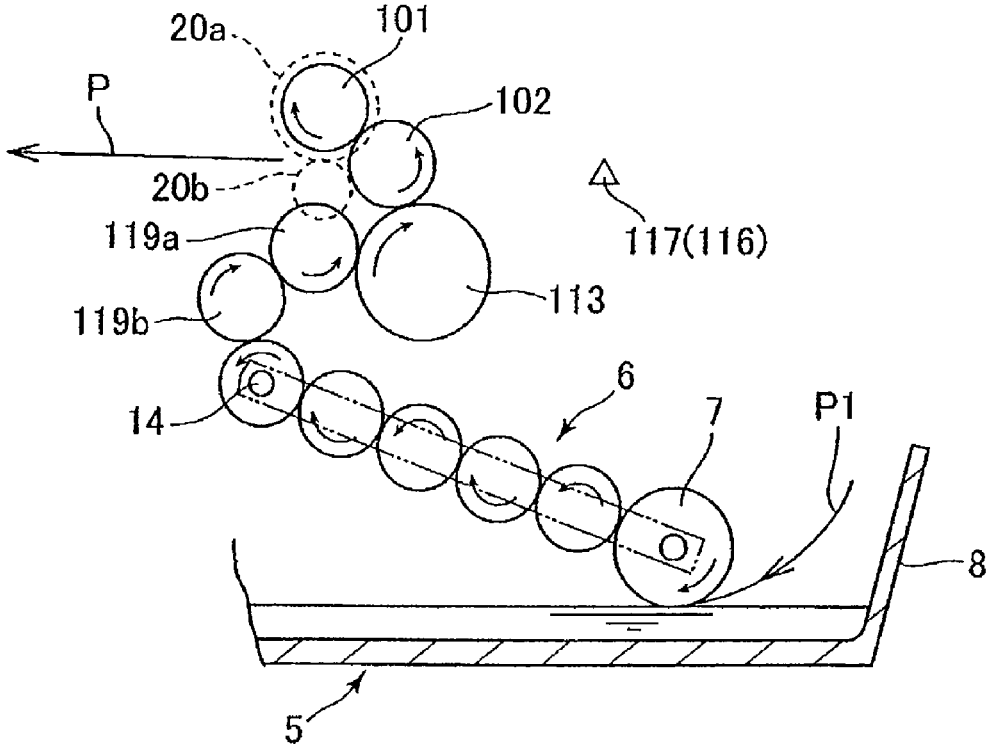
Figure 14C:
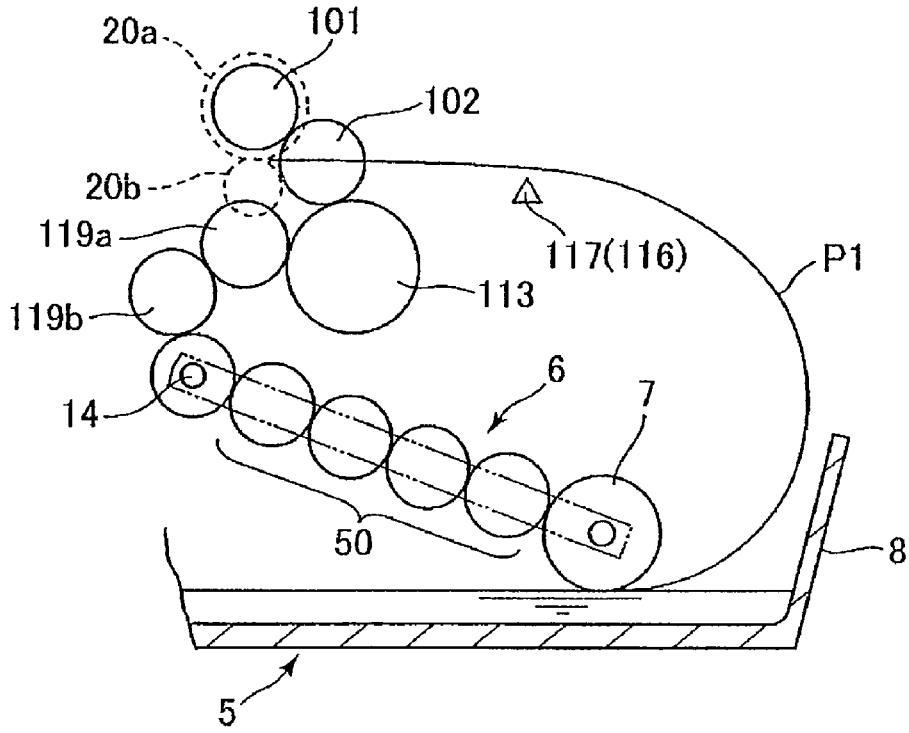
Figure 14D:
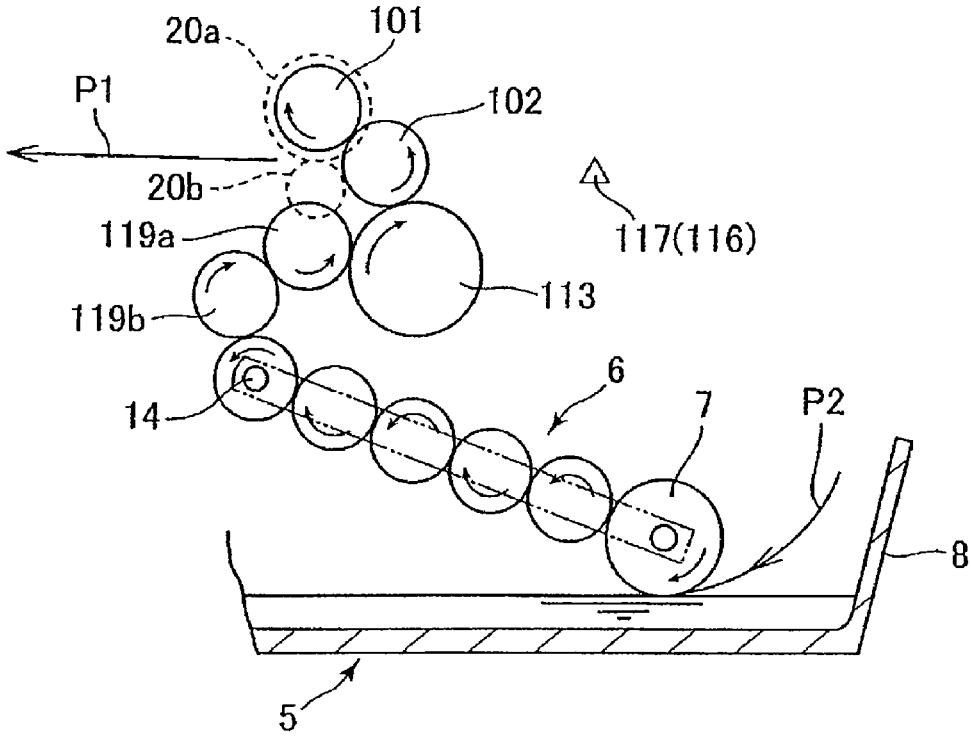

It is noted that there is a case that the leading edge of a succeeding sheet P1 has already passed the detecting position of the paper sensor 116 and is positioned farther downstream in the conveying direction, or the leading edge of the succeeding sheet P1 is already gripped by the registration rollers 20 when one page worth of image recording is completed on the preceding sheet of paper P during the continuous feeding operation. In such a case, the succeeding sheet of paper P1 is conveyed to the discharge side as shown in FIG. 14C and FIG. 14D. On the other hand, there is another case that the leading edge of the succeeding sheet P1 is positioned upstream in the conveying direction at a position not yet detected by the registration sensor 117 when one page worth of image recording is completed on the preceding sheet of paper P during the continuous feeding operation. In such a case, a process is performed to return the second sheet of paper P1 to the paper cassette 5 as shown in FIG. 14A and FIG. 14B.

More specifically, in S16, if a command indicating the existence of a subsequent sheet has not been received (S16: NO), that is, when there is no image-recording data for a succeeding sheet of paper P1, in S20 the controller conveys the paper P positioned in the image-recording section a prescribed amount in the discharge direction equivalent to about three passes (that is, about three successive operations of the recording head 12 in the main scanning direction.)

When the paper P has been conveyed the prescribed amount (S20: YES), in S21 the controller switches the flag to the first mode. Consequently, a command to move the carriage 13 is issued, and the setting of the drive transmission switching device 100 is switched to the first mode (position 1) in S22. As a result, the carriage 13 is moved first toward the maintenance section 36 in the rightward direction E in FIG. 11B to cause the contact piece 104*a* to move from position 2 (Po2) to the position 3 (Po3), and then is moved back to the image recording region in the leftward direction C, thereby moving the contact piece 104*a* to position 1 (Po1). As a result, the switching gear 102 is engaged with the intermittent feeding transmission gear 113, as in the intermittent feeding mode described above. In this state, the controller executes image recording on the paper P that is now being positioned in the image-recording section. When the image-recording operation is finished (S17: YES), in S18 the controller checks the current state of the flag.

If the controller determines in S18 that the flag indicates the first mode (S18: first), in S30 the controller executes a control process for the succeeding sheet P1 that follows the present sheet P. This control process is shown in detail in the flowchart of FIG. 17.

In S31 of this process, the controller determines whether the registration sensor 117 is on when one page worth of image recording is completed on the preceding sheet of paper P during the continuous feeding operation (indicating that the leading edge of the succeeding sheet P1 has passed the paper sensor 116). If the registration sensor 117 is off, indicating that the leading edge of the succeeding sheet P1 has not reached the paper sensor 116 as shown in FIG. 14A (S31: NO), then in S32 the controller rotates the feeding roller 7 in reverse to return the succeeding sheet of paper P1 to the paper cassette 5.

It is noted that the carriage 13 has been already moved and has set the contact piece 104*a* in position 1 (Po1) in S21 and S22). In this position, the switching gear 102 is engaged with the intermittent feeding transmission gear 113, as in the intermittent feeding mode described above, so that a rotational force is transmitted from the intermittent feeding transmission gear 113 to the feeding roller 7 via the intermediate gears 119*a* and 119*b*. The linefeed motor 42 is driven to rotate forward so that the drive roller 20*a* of the registration rollers 20 rotates forward for conveying the preceding paper P toward the discharge section. Accordingly, the preceding sheet of paper P is conveyed toward the discharge section, while the feeding roller 7 is rotated in reverse. After the feeding roller 7 has rotated a prescribed amount (S33: YES), the controller halts the feeding roller 7 in S34, at which time the succeeding sheet of paper P1 has returned to its stacked position on the paper cassette 5 as shown in FIG. 14B.

In the case described above, the front half of the succeeding sheet of paper P1 (leading section of the paper P) is positioned in the U-shaped conveying section 9, and the trailing half is positioned on the paper cassette 5 side. Therefore, a short length of time is required to return the sheet to the paper cassette 5. Further, this method eliminates the need to reset the unrecorded sheet of paper P1 in the paper cassette 5 after the paper P1 has passed through the image-recording section and has been discharged in the discharge section.

On the other hand, if the controller determines in S31 that the registration sensor 117 is on, indicating that the leading edge of the succeeding sheet P1 has passed the paper sensor 116 (S31: YES), in S35 the controller drives the linefeed motor 42 to rotate in reverse to rotate the feeding roller 7 forward (while rotating the drive roller 20*a* in reverse). After the feeding roller 7 has rotated the prescribed amount (S36: YES), so that the leading edge of the succeeding sheet P1 contacts the registration rollers 20 to receive the registration effect, in S37 the controller halts the linefeed motor 42 temporarily to halt rotation of the drive roller 20*a* and the feeding roller 7 as shown in FIG. 14C.

In S38 the linefeed motor 42 is subsequently driven to rotate forward again for rotating the drive roller 20*a* and the drive roller 21*a* forward to discharge the succeeding paper P1 as shown in FIG. 14D. Since the feeding roller 7 is rotated in reverse at this time, a subsequent sheet of paper P2 following the succeeding sheet P1 can be returned to the paper cassette 5 after the feeding roller 7 has been rotated a prescribed amount (S39: YES).

As shown in FIG. 13B, L1 indicates the distance along the U-shaped conveying section 9 from the contact point between the feeding roller 7 and the paper P stacked in the paper cassette 5 (drawing position) and the nip position of the registration rollers 20, while L2 indicates the distance from the contact point to the separating member on the sloped separating surface 8. It is noted that the sheets of paper P are stacked in the paper cassette 5, with their leading edges being in abutment contact with the sloped separating surface 8. In a continuous feeding operation, a distance L2 indicates the amount of overlap in the preceding sheet of paper P and the succeeding sheet of P1 in the conveying direction, since the feeding roller 7 begins feeding the succeeding sheet of paper P1, whose leading edge is located at the sloped separating surface 8, the instant that the trailing edge of the preceding sheet of paper P leaves the contact point with the feeding roller 7. However, since the difference between the L2 and L1 is set greater than a prescribed value and the difference between the peripheral velocity V1 of the drive roller 20*a* and the peripheral velocity V2 of the feeding roller 7 (V1−V2, where V1>V2) is greater than a prescribed value, the leading edge of the succeeding sheet of paper P1 is delayed so as not to reach the nip position of the registration rollers 20 before the trailing edge of the preceding sheet of paper P has left the nip position toward the downstream side in the conveying direction, thereby forming a suitable gap between the trailing edge of the preceding sheet of paper P and the leading edge of the succeeding sheet of paper P1.

Hence, it is possible to record all image-recording data corresponding to each sheet of paper P at the image-recording section on the corresponding sheet of paper P, even when a plurality of sheets are fed and conveyed continuously. In other words, this method prevents the trailing edge of a preceding sheet of paper P from overlapping the leading edge of the succeeding sheet of paper P1 in the image-recording section, thereby preventing an image from being recorded over both sheets.

In the continuous feeding mode, a gap can be more reliably formed between continuously fed sheets of paper by controlling the feeding roller 7 to begin drawing or feeding the succeeding sheet of paper P1 when the trailing edge of the preceding sheet of paper P leaves the drawing position (contact point between the feeding roller 7 and the stacked sheets) so as to be conveyed only by the registration rollers 20.

In the example described above, the feeding roller 7 is configured to feed the paper P stacked in the paper cassette 5 one sheet at a time into the U-shaped conveying section 9, while the registration rollers 20 convey the sheet of paper P to the image-recording section. In the meantime, the carriage 13 reciprocates in a direction intersecting the conveying direction of the paper P, while the recording head 12 mounted on the carriage 13 records an image on the paper P. In the image-recording device 1 having this construction, the pair of registration rollers 20 is disposed on the U-shaped conveying section 9 for temporarily halting the paper P fed by the feeding roller 7 in order to adjust the registration of the paper P. The image-recording device 1 also includes the drive transmission switching device 100 disposed on one end of the reciprocating path of the carriage 13 for switching the rotating and halted states of the drive roller 20*a* in the registration rollers 20 and the feeding roller 7. The controller activates the drive transmission switching device 100 based on movement of the carriage 13 and selectively switches the transmission mode between the continuous feeding mode and the intermittent feeding mode. This construction can select a mode based on whether the user wishes to emphasize image quality over high-speed image recording, or to emphasize speed over image quality. The feeding and conveying operations can easily be switched according to the corresponding mode.

The continuous feeding mode can rapidly execute an operation to feed and convey a plurality of sheets continuously to the image-recording unit, thereby achieving efficient high-speed image recording. Further, the intermittent feeding mode can accurately perform precision image recording without skew or errors in conveying timing occurring with the recording medium being conveyed to the image-recording unit.

In the continuous feeding mode, both the drive roller 20*a* and the feeding roller 7 are continuously rotated in the forward direction for feeding and conveying the paper P. In the intermittent feeding mode, the feeding roller 7 is rotated forward in the feeding direction, while the drive roller 20*a* is rotated in reverse to temporarily halt the paper P. Subsequently, the drive roller 20*a* is rotated forward to convey the paper P, while the feeding roller 7 is rotated in reverse. The drive transmission switching device 100 maintains either of the selected modes when the carriage 13 returns over the image-recording region so that the mode does not change even when the carriage 13 is returned over the image-recording region after the mode has been selected. Accordingly, it is not necessary to perform an operation, particularly in the intermittent feeding mode, to move the carriage 13 to the drive transmission switching device 100 side for each registration operation, thereby achieving efficient image recording.

Further, the nip force between the registration rollers 20 is set greater than the conveying force at the feeding roller 7, and the peripheral velocity of the drive roller 20*a* is set greater than that of the feeding roller 7. During the continuous image recording process, the controller continuously rotates the drive roller 20*a* and the feeding roller 7 in the same direction when there exists image data for a succeeding sheet of paper P1. Hence, rather than performing a feeding operation that temporarily halts each sheet of paper P that the feeding roller feeds from the paper cassette when the leading edge of the paper P reaches the registration rollers 20, the image-recording device 1 can convey a plurality of sheets of paper P to the image-recording section continuously for image recording, thereby achieving efficient image recording through a simple construction while improving the speed of a continuous image recording process performed on a plurality of sheets of paper P.

Further, the image-recording device 1 includes the registration rollers 20 disposed upstream of the carriage 13 in the paper-conveying direction, and the feeding roller 7 disposed farther upstream in the paper-conveying direction. Since the single linefeed motor 42 can be used to rotate the drive roller 20*a* of the registration rollers 20 and the feeding roller 7 in the same direction, it is possible to feed and convey the paper through a simple construction.

By disposing the feeding roller 7 on the distal end of the feeding arm 6*a*, and enabling the feeding arm 6*a* to pivot for placing the feeding roller 7 in contact with the top surface of the paper P stacked in the paper cassette 5 from above and separating the feeding roller 7 from the top surface of the paper P stacked in the paper cassette 5, this construction can facilitate a continuous feeding operation.

Further, the same feeding unit 6 can be used to implement a structure for switching between the intermittent feeding mode (precision image recording) and the continuous feeding mode (high-speed image recording).

The feeding roller 7 is disposed on the pivoting arm 6*a* that is capable of placing the feeding roller 7 in contact with or separating the feeding roller 7 from the top surface of the stacked sheets of recording paper. Because the nip force between the registration rollers 20 is greater than the conveying force at the feeding roller 7, even when rotating the feeding roller 7 in reverse during the intermittent feeding mode, the feeding roller 7 rises up together with the arm 6*a* from the surface of the recording paper, enabling the registration rollers 20 to reliably convey the recording paper.

While the invention has been described in detail with reference to the above aspect thereof, it would be apparent to those skilled in the art that various changes and modifications may be made therein without departing from the spirit of the invention.

For example, a plurality of paper cassettes may be provided in the image-recording device, and the continuous feeding operation may be executed for feeding paper from each paper cassette.

What is claimed is:

1. An image-recording device for recording an image on a recording medium, the image-recording device comprising:

a media-accommodating unit that accommodates a plurality of recording media in a stacked state;

a conveying path along which the recording medium is conveyed;

a feeding roller that contacts the recording media in the media-accommodating unit and feeds the recording media one at a time from the media-accommodating unit along the conveying path;

a pair of registration rollers disposed on the conveying path and conveying the recording medium fed by the feeding roller to an image-recording region, the registration rollers including a drive roller;

an image-recording unit comprising a carriage that reciprocates in the image-recording region in a direction intersecting a conveying direction in which the recording medium is conveyed, and a recording head mounted on the carriage and recording an image on the recording medium;

a drive transmission switching unit disposed outside the image-recording region on one end with respect to the reciprocating direction of the carriage and switching a combination of a forward rotating state and a reverse rotating state of the drive roller of the registration rollers and the feeding roller between a continuous feeding mode and an intermittent feeding mode; and a controlling unit that activates the drive transmission switching unit by moving the carriage to selectively switch between the continuous feeding mode and the intermittent feeding mode, wherein in the continuous feeding mode, the controlling unit drives the drive roller of the registration rollers and the feeding roller simultaneously with each other to rotate in a forward direction during a time period from when the feeding roller starts feeding a preceding recording medium until the feeding roller starts feeding a succeeding recording medium, such that a leading edge of the preceding recording medium is fed through the registration rollers within the time period, and wherein, during the time period, the drive roller does not stop rotating in the forward direction while the feeding roller is rotating in the forward direction.

2. The image-recording device according to claim 1, wherein in the intermittent feeding mode, the controlling unit temporarily halts the recording medium by driving the feeding roller to rotate forward while driving the drive roller of the registration rollers to rotate in reverse, and subsequently conveys the recording medium by driving the feeding roller to rotate in reverse and driving the drive roller to rotate forward.

3. The image-recording device according to claim 1, wherein the drive transmission switching unit comprises a maintaining unit that maintains the selected mode when the carriage is returned to the image-recording region.

4. The image-recording device according to claim 1, wherein in the continuous mode, the controlling unit controls the feeding roller to start feeding the succeeding recording medium when the trailing edge of the preceding recording medium leaves a feeding position of the feeding roller and is conveyed only by the pair of registration rollers.

5. The image-recording device according to claim 1, wherein the controlling unit comprises a single common drive motor for driving the drive roller of the pair of registration rollers and the feeding roller.

6. The image-recording device according to claim 1, further comprising an arm member on which the feeding roller is disposed, the arm member being capable of pivoting to allow the feeding roller to contact and separate from a top surface of the stacked recording media.

7. The image-recording device according to claim 1, wherein the feeding roller has a circular cross-section.

8. The image-recording device according to claim 1, wherein a nip force between the pair of registration rollers is set greater than a conveying force at the feeding roller;

the peripheral velocity of the drive roller is set greater than the peripheral velocity of the feeding roller; and when there exists the image data for the succeeding recording medium in the continuous feeding mode, the controlling unit continues to drive the drive roller and the feeding roller simultaneously with each other to rotate in the forward direction.

9. The image-recording device according to claim 8, wherein when there exists no image data for the succeeding recording medium in the continuous feeding mode, the controlling unit switches the continuous feeding mode into the intermittent feeding mode, and rotates the feeding roller in a reverse direction to return the succeeding recording medium back to the media-accommodating unit if the succeeding recording medium has not yet reached a medium sensor when recording on the preceding recording medium is completed.

10. The image-recording device according to claim 9, wherein when there exists no image data for the succeeding recording medium in the continuous feeding mode, the controlling unit switches the continuous feeding mode into the intermittent feeding mode, and rotates the feeding roller in the forward direction and then rotates the pair of registration rollers in the forward direction if the succeeding recording medium has already reached a medium sensor when recording on the preceding recording medium is completed.

11. The image-recording device according to claim 1, further comprising:

a first drive force transmitting unit that transmits a drive force of the drive roller in the pair of registration rollers to the feeding roller during the intermittent feeding mode; and a second drive force transmitting unit that transmits the drive force of the drive roller to the feeding roller during the continuous feeding mode, the first drive force transmitting unit and the second drive force transmitting unit being disposed outside the image-recording region and being arranged on the one end with respect to the reciprocating direction of the carriage in a direction away from the image-recording region.

12. The image-recording device according to claim 11, wherein the first drive force transmitting unit includes a first transmission gear, the second drive force transmitting unit includes a second transmission gear, and the first transmission gear and the second transmission gear are arranged to rotate coaxially, wherein the drive roller has a drive gear that rotates around its axis that extends parallel to the coaxial rotation axis of the first transmission gear and the second transmission gear, and wherein the drive transmission switching unit includes:

a switching gear that is capable of being engaged with the drive gear and either one of the first transmission gear and the second transmission gear; and a contact piece that is capable of being in abutment contact with the carriage to move the switching gear in a direction of movement of the carriage.

13. The image-recording device according to claim 12, wherein the drive gear rotates together with the drive roller.

* * * * *